US007527514B2

(12) United States Patent
Tsuji

(10) Patent No.: US 7,527,514 B2
(45) Date of Patent: May 5, 2009

(54) FIT-IN MEMBER

(75) Inventor: Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 54 days.

(21) Appl. No.: 11/818,491

(22) Filed: Jun. 14, 2007

(65) Prior Publication Data

US 2008/0009171 A1 Jan. 10, 2008

(30) Foreign Application Priority Data

Jun. 16, 2006 (JP) ..... 2006-168030

(51) Int. Cl.
*H01R 13/627* (2006.01)

(52) U.S. Cl. ..... 439/352

(58) Field of Classification Search ..... 439/352, 439/357–359, 353, 489
See application file for complete search history.

(56) References Cited

U.S. PATENT DOCUMENTS

| | | | | |
|---|---|---|---|---|
| 4,915,642 | A | 4/1990 | Lin et al. | |
| 5,195,904 | A | 3/1993 | Cyvoct | |
| 5,919,056 | A | 7/1999 | Suzuki et al. | |
| 6,027,364 | A | 2/2000 | Fukuda | |
| 6,358,081 | B1 * | 3/2002 | Saka et al. | 439/352 |
| 6,475,014 | B2 * | 11/2002 | Tsuji et al. | 439/352 |
| 7,128,595 | B2 * | 10/2006 | Boutros | 439/358 |

FOREIGN PATENT DOCUMENTS

| | | |
|---|---|---|
| JP | 4-133373 | 11/1992 |
| JP | 7-335320 | 12/1995 |
| JP | 2002-82538 | 3/2000 |

* cited by examiner

*Primary Examiner*—Renee Luebke
*Assistant Examiner*—Larisa Tsukerman
(74) *Attorney, Agent, or Firm*—Gerald E. Hespos; Anthony J. Casella

(57) ABSTRACT

A slider (62) slidable in a direction in which a male connector (4) is fitted in a female connector (5) and a direction in which the male connector (4) is separated from the female connector (5) is mounted on the female connector (5). When an operation of moving the slider (62) rearward is performed, an unlocking projected portion (66) slides along an unlocking guide surface (78) of the slider (62). As a result, a locking arm (63) is displaced in an unlocking direction. At this time, a stopping surface (74) of a spring-accommodating portion (67) contacts the slider (62). As a result, the slider (62) and a female connector housing (41) are held as a unit. Thereafter by performing the operation of moving the slider (62) rearward, the male connector (4) and the female connector (5) can be separated from each other.

16 Claims, 24 Drawing Sheets

FIT-IN MEMBER

BACKGROUND OF THE INVENTION

1. Field of the Invention

The present invention relates to a fit-in member such as a connector.

2. Description of the Related Art

Japanese Patent Application Laid-Open No. 2000-113934 discloses an assembly of fit-in members including a male connector that can be fit in a female connector. One connector has a locking arm and the other connector has a locking projection that can be locked to the locking arm when the male connector is fit in the female connector. A handle is on the connector with the locking arm and an unlocking gripping lever is provided in the handle. The lever can be gripped when the male connector is fit in the female connector, and the gripped lever can be operated to displace the locking arm in the unlocking direction. Thus, the male and female connectors are separated from each other.

The locking arm of Japanese Patent Application Laid-Open No. 2000-113934 has a comparatively small operational area and is difficult to operate. However, the male connector and the female connector of Japanese Patent Application Laid-Open No. 2000-113934 are separated from each other by operating the gripping lever instead of the locking arm. The lever of Japanese Patent Application Laid-Open No. 2000-113934 can be gripped with entire fingers. Therefore, the male connector and the female connector can be separated from each other easily.

To separate the above-described male and the female connectors from each other, it is necessary to perform an operation of separating the connectors in addition to the unlocking operation performed by gripping the lever. Hence, two operational steps are performed in different directions. Separation of the male and female connectors from each other desirably should be performed more smoothly.

The invention has been completed in view of the above-described situation. Therefore it is an object of the invention to provide a pair of fit-in members that can be separated efficiently.

SUMMARY OF THE INVENTION

The invention is directed to an assembly of first member that can be fit in a second fit-in member. A locking arm is disposed on the first fit-in member and a to-be-locked portion is disposed on the second fit-in member. The to-be-locked portion can be locked to the locking arm when the first fit-in member is fit in the second fit-in member. A slider mounted on the first fit-in member for sliding movement in the direction in which the first fit-in member is separated from the second fit-in member. An interlocking portion is provided on the slider and/or the locking arm for displacing the locking arm in a direction for unlocking the locking arm as the slider is slid. A stopping surface holds the slider and the first fit-in member together as a unit. More particularly, the stopping surface is provided on the first fit-in member and contacts the slider when the locking arm is unlocked from the to-be-locked portion, thus preventing the operation of sliding the slider from being performed.

The slider preferably is a tube that is open in a direction in which the first fit-in member is fit in and separated from the second fit-in member. The slider preferably is mounted on the first fit-in member and surrounds an entire periphery of a housing of the first fit-in member.

A finger-applying portion preferably is formed on opposite outer side surfaces of the slider and has convex and concave portions for preventing slippage of operator's fingers.

The finger-applying portion preferably is thickest at a central portion along the direction in which the fit-in members are fit in and separated from each other fit-in and becomes thinner from the central portion towards the ends along the direction in which the fit-in members are fit in and separated from on another.

A return spring preferably is incorporated in the first fit-in member in a direction in which the fit-in members are fit in and separated from one another. One end of the return spring contacts the housing of the first fit-in member and the other end of the return spring contacts the slider to urge the slider in a return direction.

The locking arm preferably is at a widthwise central portion of an outer surface of the housing of the first fit-in member and extends in the direction in which the fit-in members are fit in and separated. Stopping surfaces symmetrically sandwich the locking arm therebetween in the widthwise direction of the housing.

A spring-accommodating portion preferably is formed on the first fit-in member and has an opening at one end for receiving the return spring. The stopping surfaces are defined at the periphery of the opening of the spring-accommodating portion.

The locking arm preferably has opposite front and rear ends and a fulcrum therebetween. Thus, the locking arm is like a seesaw and can displace about the fulcrum in a vertical plane in the housing of the first fit-in member. A locking portion is formed at a front end of the locking arm and can lockingly engage the to-be-locked portion. An inclined unlocking guide surface is formed on the rear end of the locking arm or on the slider and functions to displace the front end of the locking arm in a direction for disengaging the locking portion from the to-be-locked portion. The unlocking guide surface slides in contact with a mating portion when the slider is slid.

The to-be-locked portion preferably is a projection formed on the second fit-in member; in fitting the one fit-in member in the other fit-in member. The locking arm and the to-be-locked projection are locked together when the locking portion of the locking arm rides across the to-be-locked projection and elastically returns to an original state thereof. The slider accommodates a displacement-permitting space for permitting deflection of the locking arm. An unlocking projection preferably is formed at the rear end of the locking arm and projects towards an opposed surface of the slider, and the unlocking guide surface is formed on the opposed surface of the slider.

Both fit-in members preferably are connectors. Alternatively, one fit-in member may be a cap that can be mounted on the other fit-in member.

Preferably in separating both fit-in members from each other in a fit-in state in which the locking arm and the to-be-locked portion are locked to each other, the slider is moved along the direction in which the fit-in members are separated from each other. This sliding movement of the slider causes the interlocking portion to displace the locking arm in the unlocking direction. As a result, the locking arm and the to-be-locked portion are unlocked from each other. At the same time, the slider contacts the stopping surface on the first fit-in member to prevent further movement of the slider relative to the first fit-in member. As a result, the slider and the first fit-in member are held together as a unit, and a further operational force applied to the slider can separate the first fit-in member from the second fit-in member. Thus, mere movement of the slider unlocks the locking arm from the to-be-locked portion and separates the fit-in members from each other. In this manner, the separation of the fit-in members from each other can be accomplished smoothly.

The slider preferably surrounds the entire periphery of the housing of the first fit-in member. Therefore, foreign matter cannot be caught between the slider and the housing of the fit-in member and the slider operates smoothly.

Preferably, the finger-applying portions can be gripped at opposite widthwise sides of the slider to move the slider in a direction separating the fit-in members from each other. Thus, the operation of separating both fit-in members from each other can be performed easily.

The inclination of the finger-applying portion preferably is changed at the central portion of the slider. Therefore it is easy to apply fingers to the finger-applying portion to fit the first fit-in member in the second fit-in member or to separate them from each other.

The return spring preferably can return the slider automatically to an initial position. Therefore it is unnecessary to perform a manual return operation.

Two stopping surfaces preferably are formed at positions to sandwich the locking arm therebetween, with the stopping surfaces disposed symmetrically with respect to the locking arm. Therefore it is possible to apply an operation force to both fit-in members in the operation of separating the fit-in members from each other.

The stopping surface preferably is on the spring-accommodating portion to simplify the construction of the first fit-in member.

The unlocking guide surface on the rear end of the locking arm or on the slider preferably slides in contact with the mating portion as the slider is operated, and applies a force in a direction to unlock the locking arm and the to-be-locked portion from each other. Thus, the locking arm smoothly performs an unlocking operation.

The slider covers the entire periphery of the first fit-in member. Thus, it is necessary to have a displacement-permitting space in the slider with a height that permits the locking arm to be displaced sufficiently to ride over the to-be-locked projection. Accordingly, a gap having a height almost equal to the height of the displacement-permitting space is formed at the end of the locking arm opposite to the end with the locking claw. The unlocking projection is formed at the unlocking rear end of the locking arm and projects toward the slider. Thus, the unlocking projection slidably contacts the unlocking guide surface on the slider, which allows the unlocking operation to be accomplished securely.

DETAILED DESCRIPTION OF THE PREFERRED EMBODIMENTS

Figure 1:
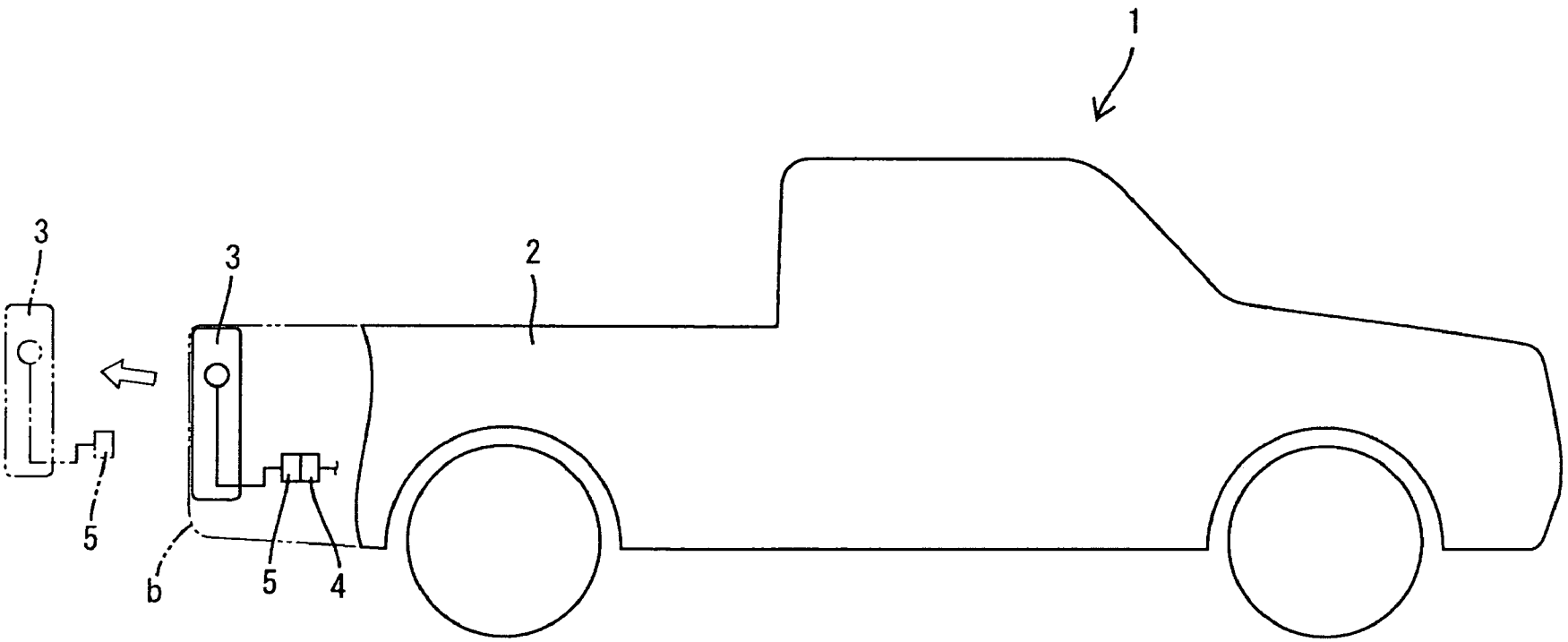
FIG. 1 is schematic view showing a situation in which connectors of an embodiment of the present invention are disposed.

A vehicle, such as a pick-up truck, is identified generally by the numeral 1 in FIG. 1. A bed 2 is disposed in a rear part of the vehicle 1 and a tail gate 3 is disposed in a rear part of the bed 2. The tail gate 3 can be opened, closed and removed from the bed 2. An electric apparatus (not shown) called a back monitor for allowing a driver to check the situation rearward from the bed 2 is mounted on the tail gate 3. Thus a vehicle body b including the bed 2 and the tail gate 3 are connected to each other with an electric wire. Male and female connectors 4, 5 are provided midway on the electric wire for the times when the tail gate 3 is removed from the bed 2. The male connector 4 is connected with an end of the electric wire at the vehicle body b, whereas the female connector 5 is connected with an end of the electric wire at the tail gate 3.

Figure 2:
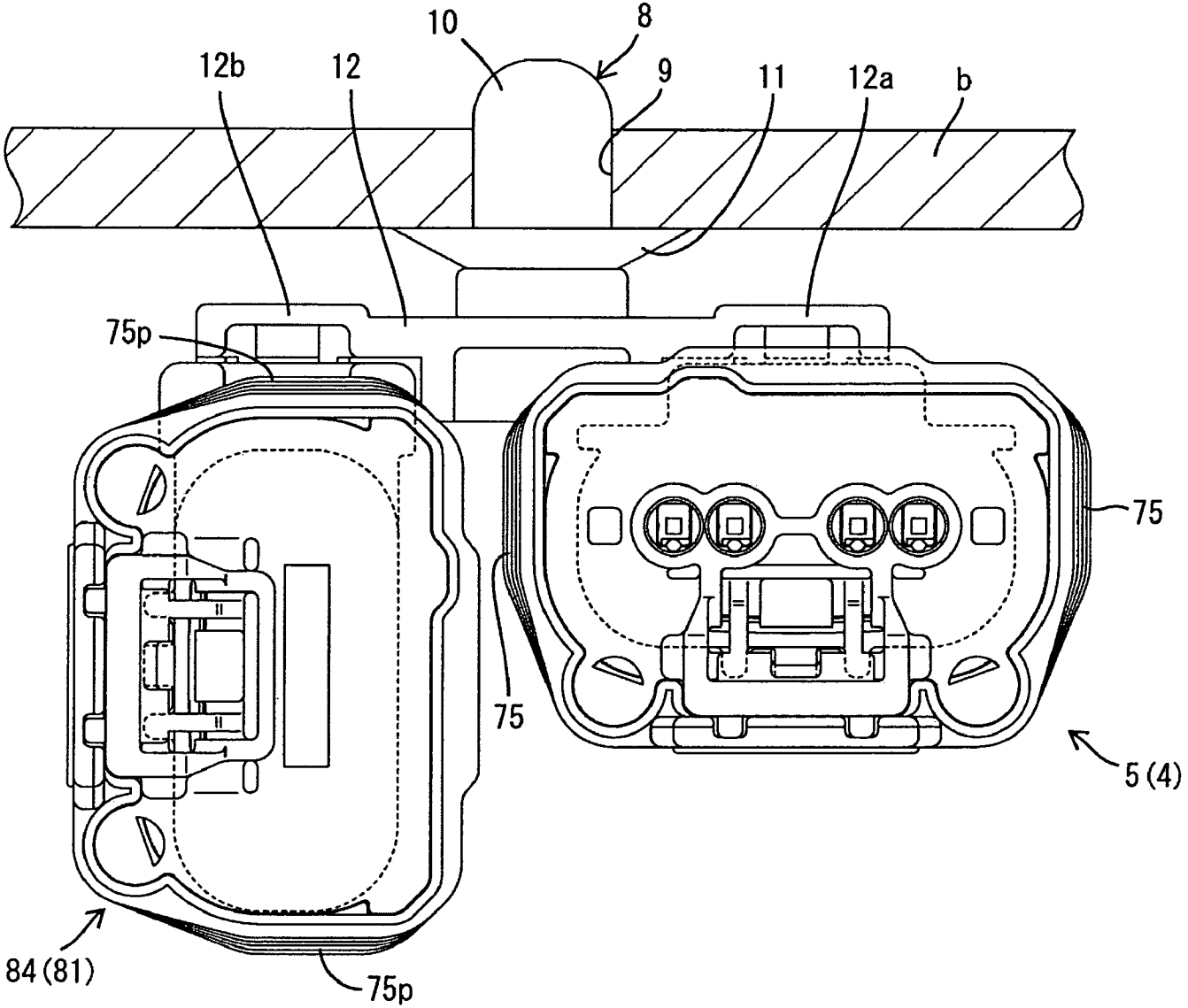
FIG. 2 is a sectional view showing a construction of holding the connectors and caps.
Figure 3:
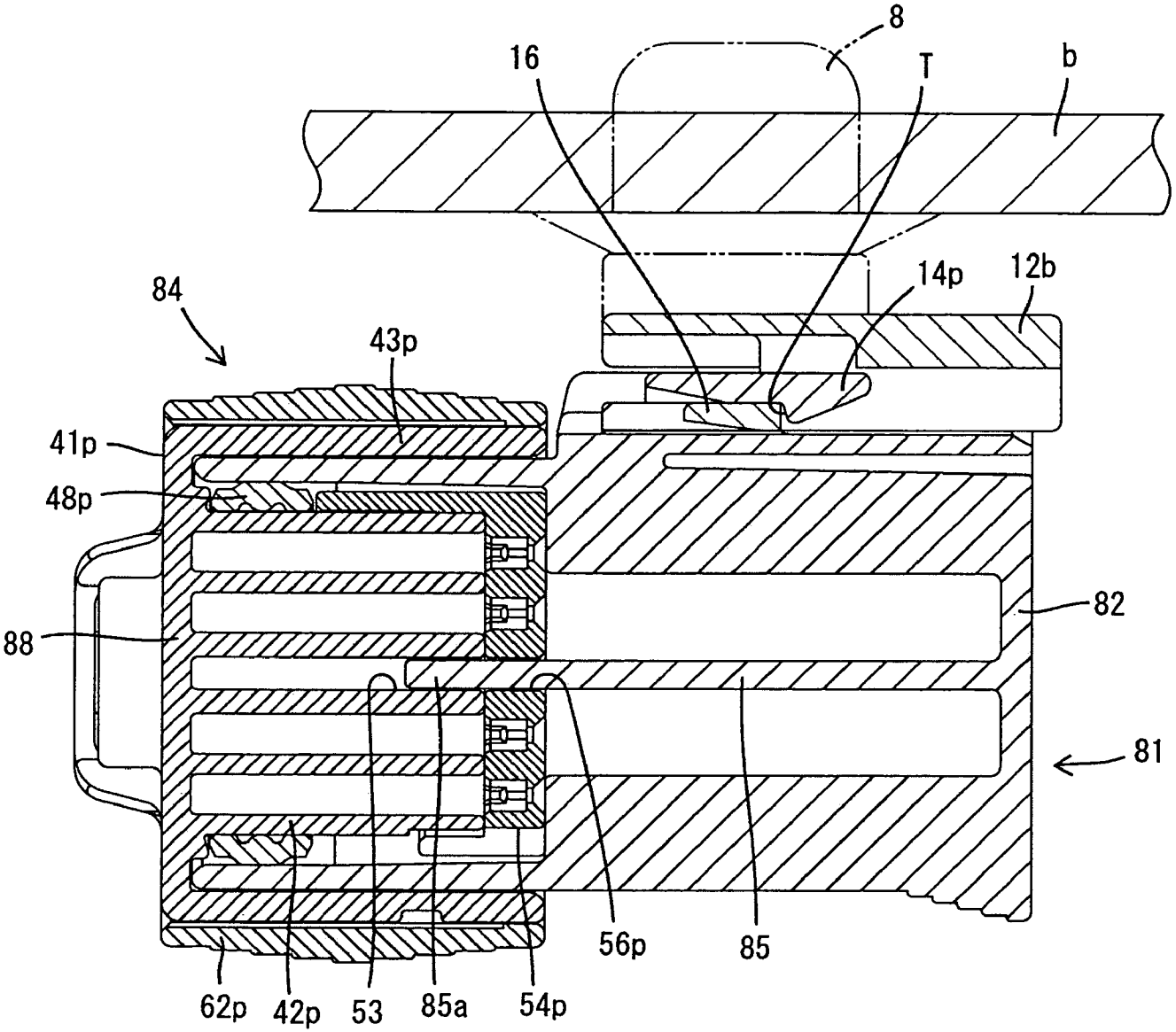
FIG. 3 is a sectional view showing a situation in which the caps are held in a fit-in state.
Figure 4:
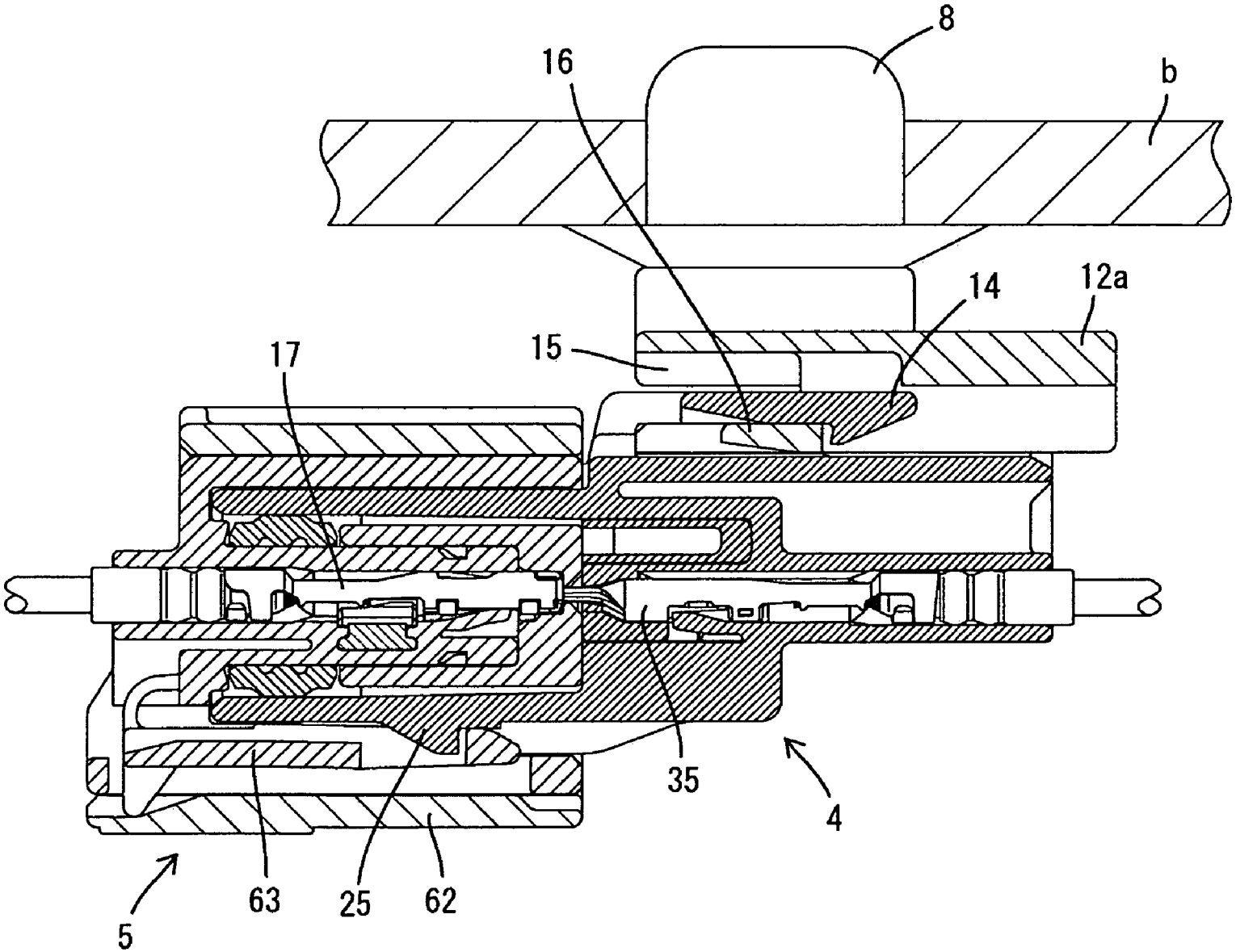
FIG. 4 is a sectional view showing a situation in which the connectors are held in a fit-in state.
Figure 5:
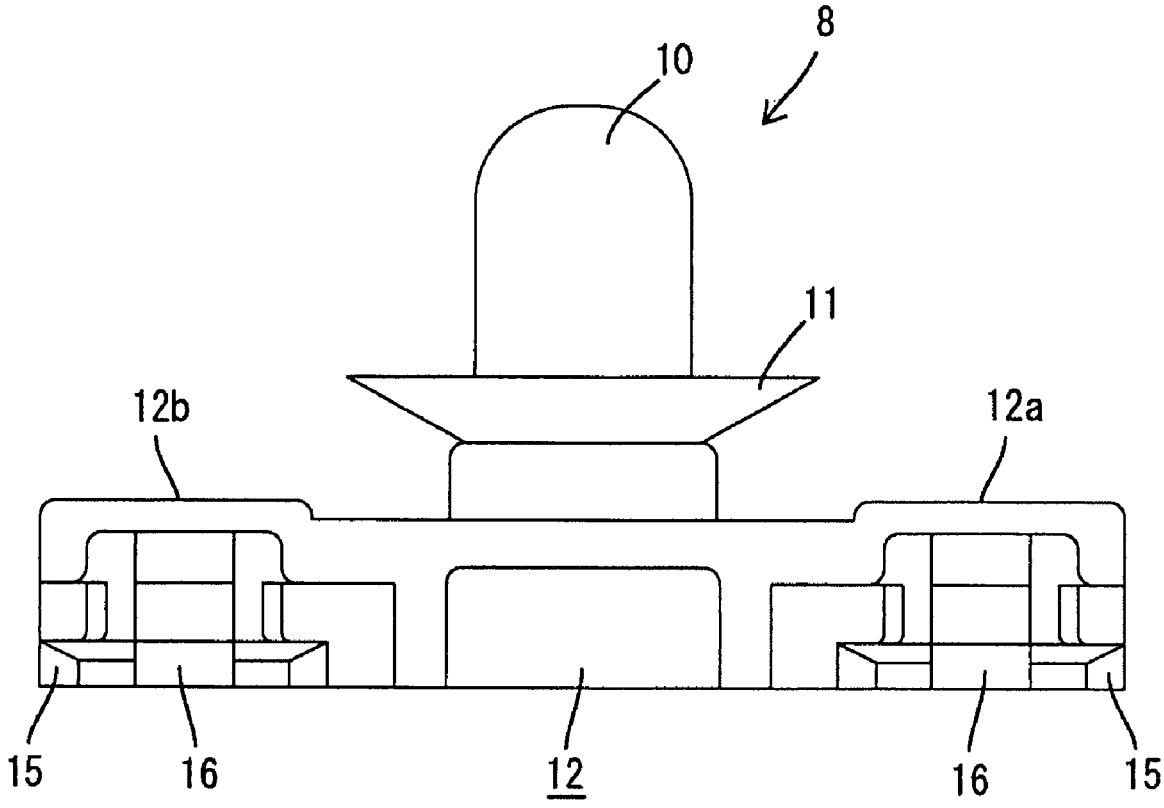
FIG. 5 is a front view showing a holder.

As shown in FIGS. 2 through 4, a holder 8 is fixed to the vehicle body b and is configured for holding the connectors 4, 5. The holder 8 also holds a male cap 81 for the female connector 5 and a female cap 84 for the male connector 4 when the male and female connectors 4, 5 are not used. The holder 8 is molded unitarily from a synthetic resin and has a leg 10 to be inserted into a mounting hole 9 that penetrates through a panel of the vehicle body b. A cover 11 projects from a midway portion of the leg 10 to cover the mounting hole 9. A base of the leg 10 is continuous with a holding part 12 that is configured for holding the connectors 4, 5 and the caps 81, 84. The holding part 12 includes a connector-holding portion 12*a* shown at a right side in FIG. 5 and a cap-holding portion 12*b* shown at a left side in FIG. 5. The connector-holding portion 12*a* and the cap-holding portion 12*b* have the same construction. The connector-holding portion 12*a* and the cap-holding portion 12*b* each has an approximately T-shaped portion 15 that that can be guided inside a holding frame 27 on a housing 13 of the male connector 4 or inside a holding frame 27*p* formed on the male cap 81 for the female connector 5. A hook 16 is formed on the T-shaped portion 15 and can be locked elastically to a claw 14 on the male connector 4 or a claw 14*p* on the male cap 81 for the female connector 5.

Figure 6:
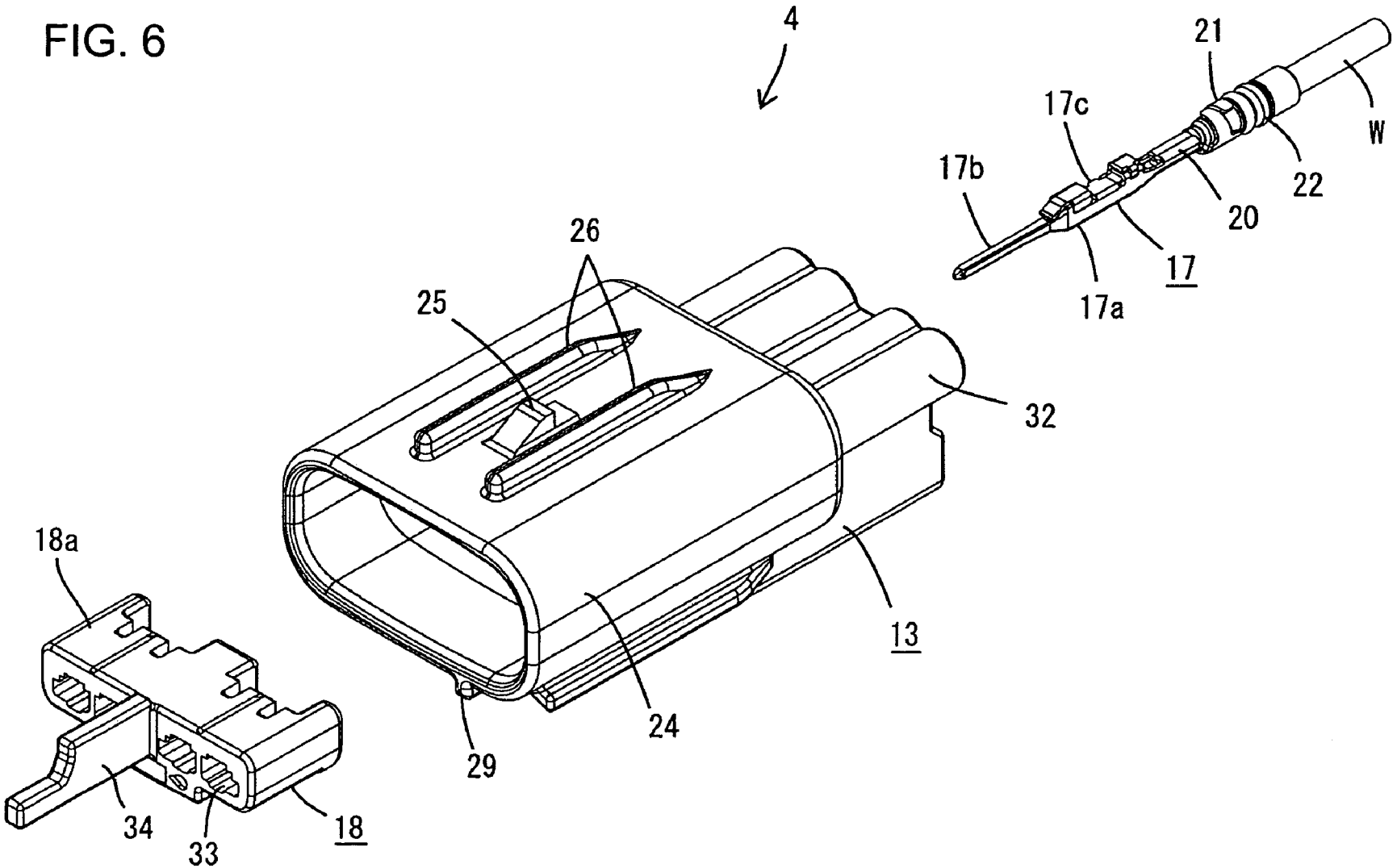
FIG. 6 is an exploded perspective view showing a male connector.

As shown in FIG. 6, the male connector 4 has the housing 13 made of synthetic resin, a male terminal fitting 17 connected with an end of an electric wire w, and a retainer 18 for preventing separation of the male terminal fitting 17.

The male terminal fitting 17 has a body 17*a*. A tab 17*b* is formed at a front end of the body 17*a* and can be connected to a female terminal fitting 35. A concave portion 17*c* is formed on a portion of the body 17*a*. A wire barrel 20 is continuous with a rear portion of the body 17*a* and is to be connected with a core of the electric wire w. An insulation barrel 21 is continuous with a rear portion of the wire barrel 20 for caulking a wire coating and a rubber plug 22 fit on the wire coating.

Figure 15:
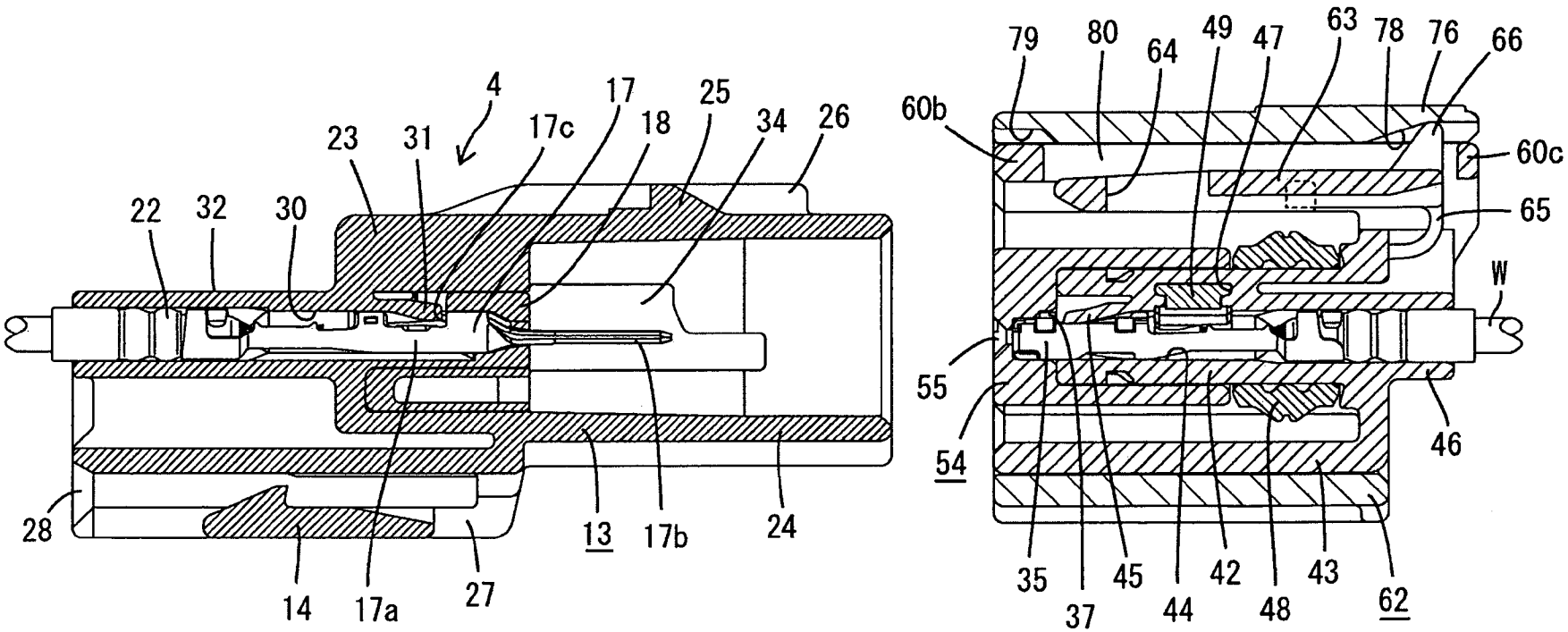
FIG. 15 is a side sectional view showing a state before the male connector is fitted in the female connector.

The male housing 13 has a terminal-accommodating portion 23 for accommodating the male terminal fitting 17, as shown in FIG. 15. A forwardly open tubular hood 24 is disposed forward from the terminal-accommodating portion 23 and a projection 25 is formed on the exterior of a longer surface of the hood 24. The projection 25 is at a front center portion of the hood 24. Protection walls 26 extend in longitudinally along the male housing 13 at opposite sides of the projection 25 and have heights almost equal to the projection 25. A holding frame 27 is formed on the outer surface of the male housing 13 opposite to the outer surface that has the projection 25. The holding frame 27 has a rearwardly open insertion opening 28 for receiving the T-shaped portion 15 of the connector-holding portion 12*a*. An elastically deformable claw 14 is disposed on an outer surface of the holding frame 27 and can be locked to the holder 8.

An erroneous fit-in prevention rib 29 is formed at one side of the outer surface of the hood 24 with respect to the widthwise center thereof, as shown in FIG. 6, and extends in a range from the front end of the hood 24 to the holding frame 27. The rib 29 guides the male connector 4 into the female connector 5.

Figure 7:
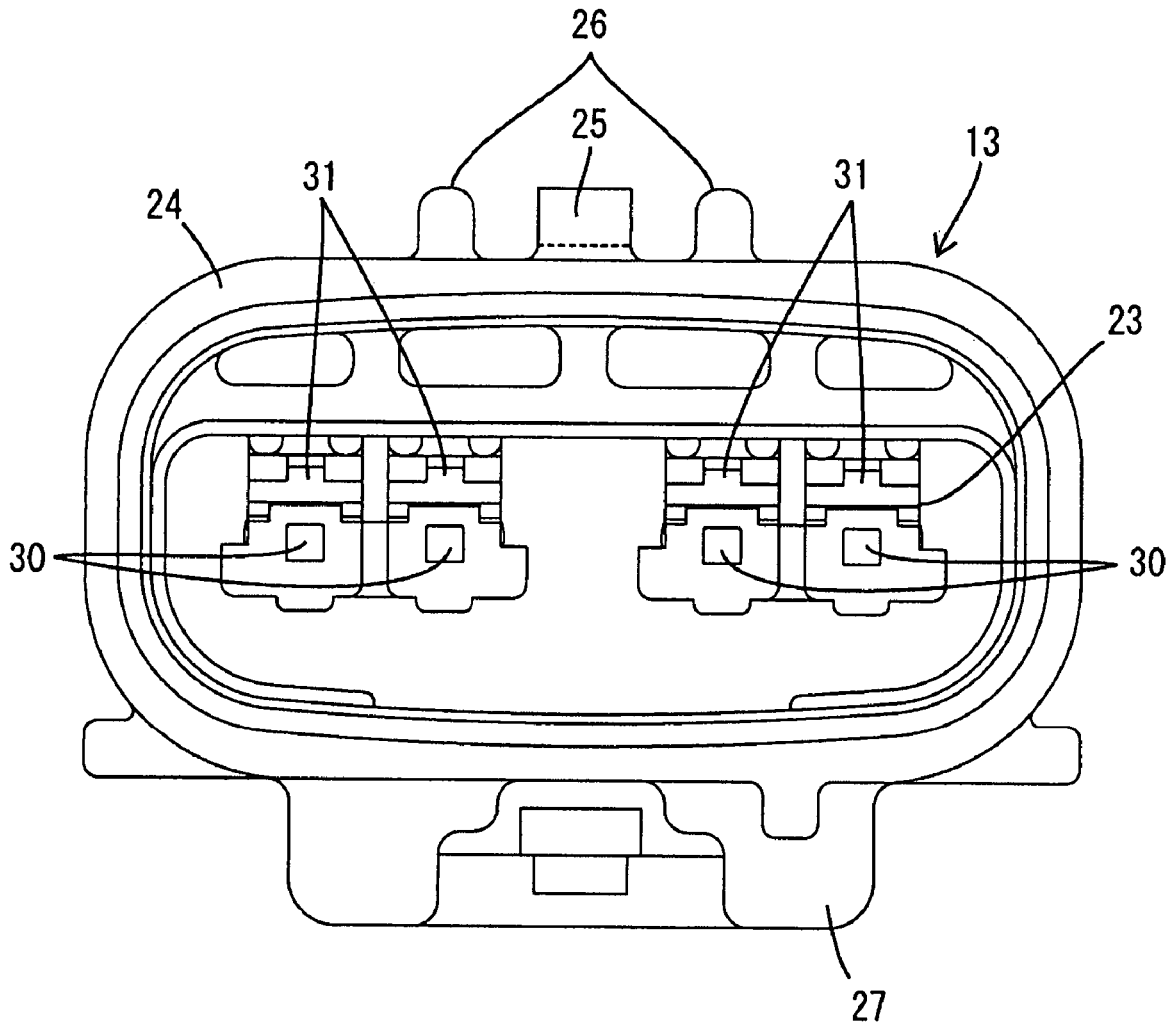
FIG. 7 is a front view showing a male connector housing.
Figure 8:
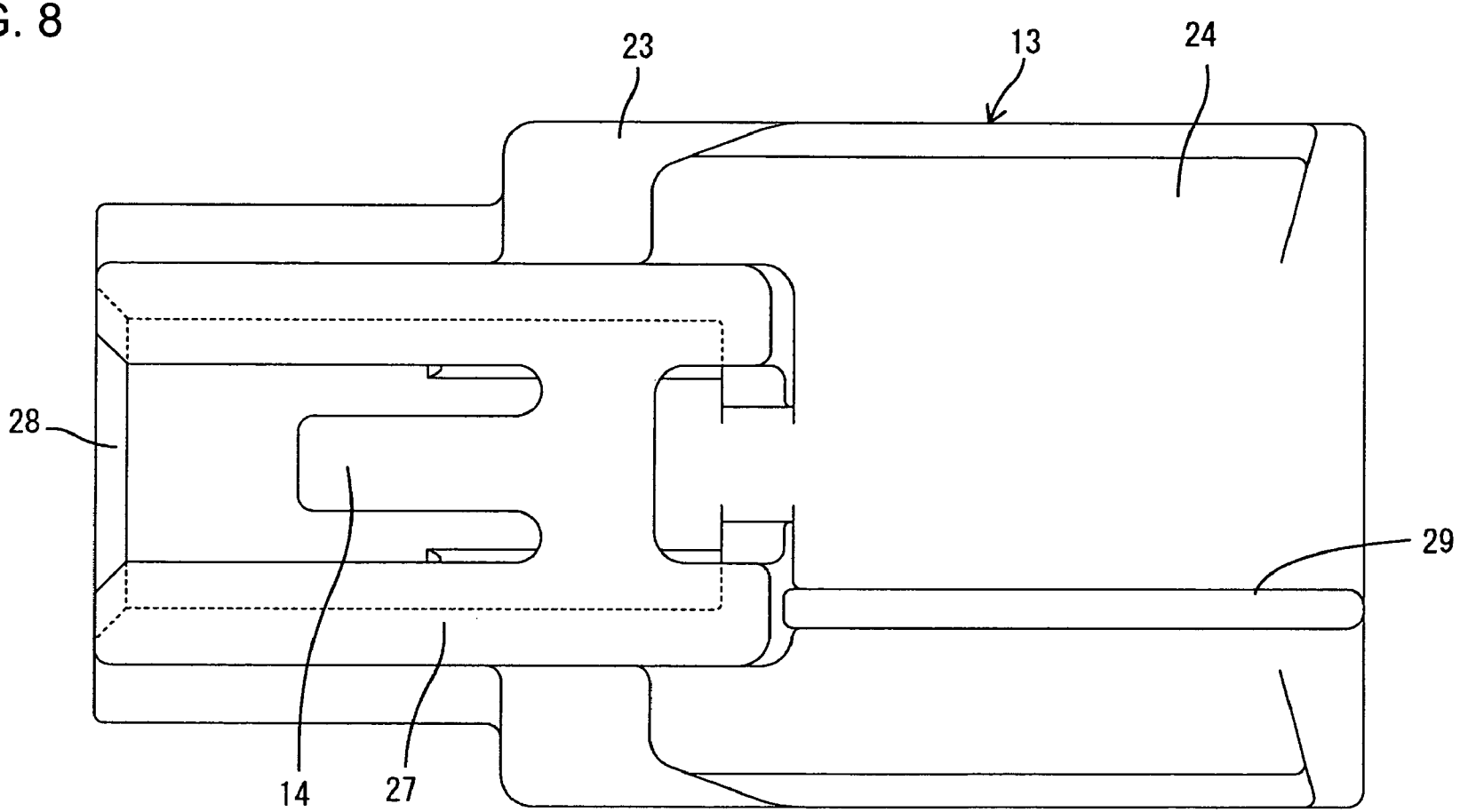
FIG. 8 is a bottom view showing the male connector housing.

Four cavities 30 are arranged side by side in the width direction of the male housing 13, as shown in FIG. 7, and penetrate the terminal-accommodating portion 23 longitudinally. The cavities 30 are configured to receive the male terminal fittings 17. A lance 31 is cantilevered obliquely forward from a portion of each cavity 30 continuous with a rear wall of the hood 24, as shown in FIGS. 7 and 15. The lance 31 flexes as the male terminal fitting 17 is inserted into the respective cavity 30. However, the lance 31 returns resiliently to its original state after the male terminal fitting 17 passes and locks the concave portion 17*c* of the male terminal fitting 17. A seal tower 32 is formed at the rear of the terminal-accommodating portion 23 and accommodates the rubber plug 22 fit on the electric wire. Portions of the cavities 30 in the seal tower 32 are cylindrical.

The male connector 4 further has a retainer 18 with a body 18*a* that can fit on the front of the terminal accommodating portion 23 from the outside, as shown in FIG. 6. Windows 33 are formed side-by-side in the retainer body 18*a* and communicate with the respective cavities 30. A grip 34 projects forward from a widthwise center of a front surface of the body 18*a* and defines a guide to fit the male connector 4 in the female connector 5. An operator can grasp the grip 34 manually to fit the retainer 18 to a normal depth in the terminal-accommodating portion 23. As a result, the retainer 18 advances partly into a flexing space of each lance 31 and prevents each lance 31 from flexing. Thus, the retainer 18 cooperates with the lance 31 to achieve secondary locking of the male terminal fitting 17.

Figure 9:
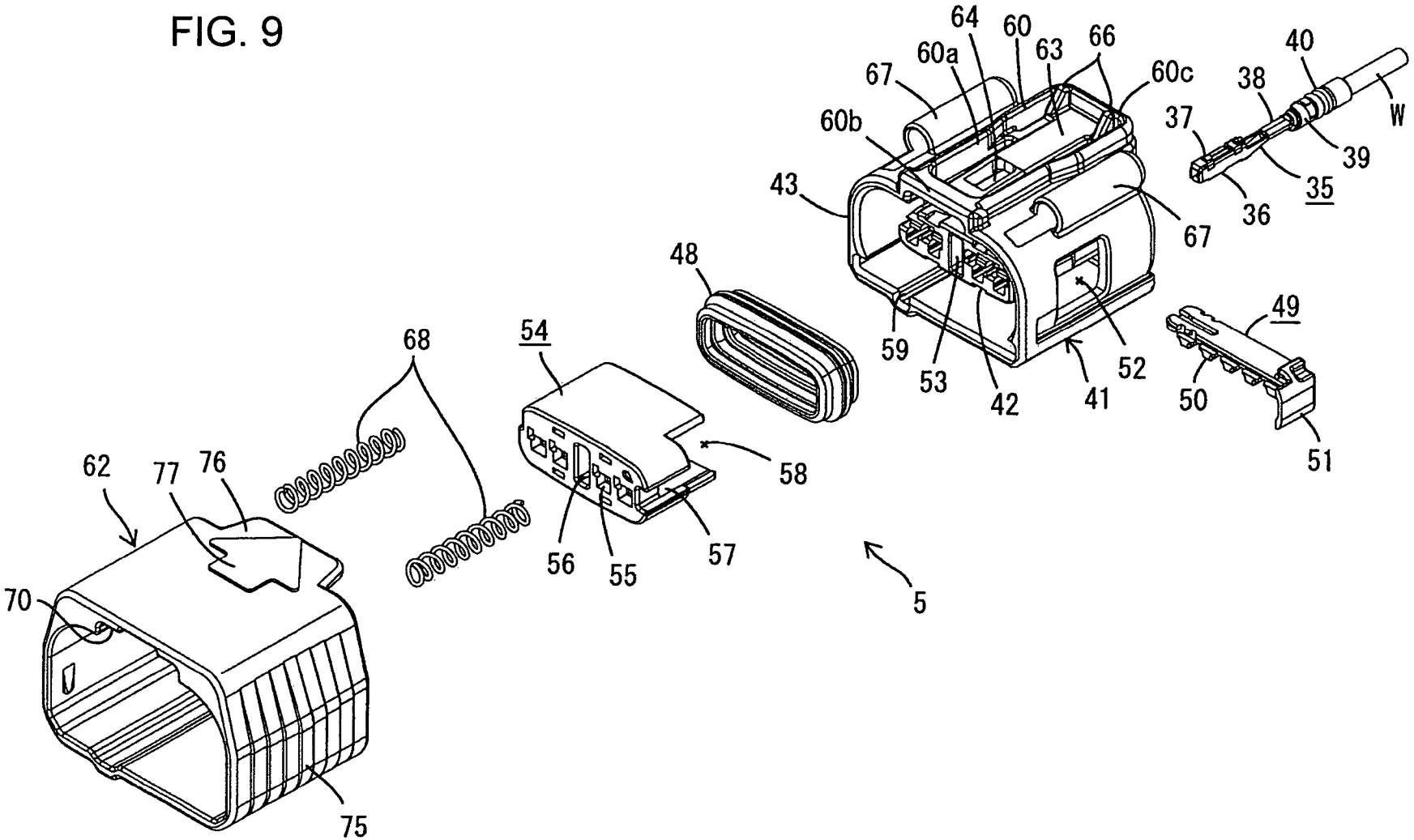
FIG. 9 is an exploded perspective view showing a female connector.

As shown in FIG. 9, the female terminal fitting 35 has an approximately square tubular connection portion 36 that can receive the tab 17*b* of the male terminal fitting 17 to connect the male and female terminal fittings 17 and 35. A projection 37 is formed on an outer surface of the tubular connection portion 36. A wire barrel 38 is continuous with the rear of the tubular connection portion 36 and an insulation barrel 39 is behind the wire barrel 38. The wire barrel 38 is crimped into connection with the core wire of the electric wire w. The insulation barrel 39 is caulked into connection with the coating and the rubber plug 40 on the wire w.

Figure 20:
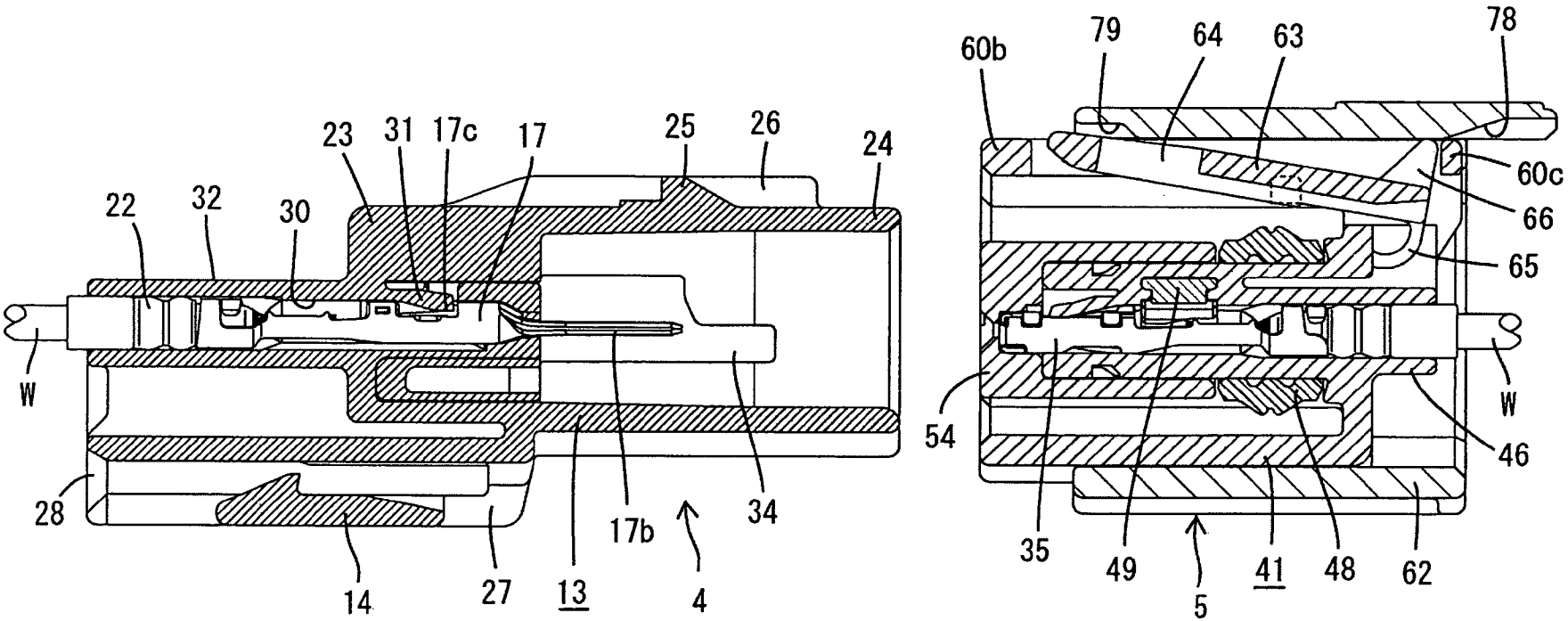
FIG. 20 is a side sectional view showing a state in which the male connector has been separated from the female connector and a state before the slider returns to its original position.
Figure 21:
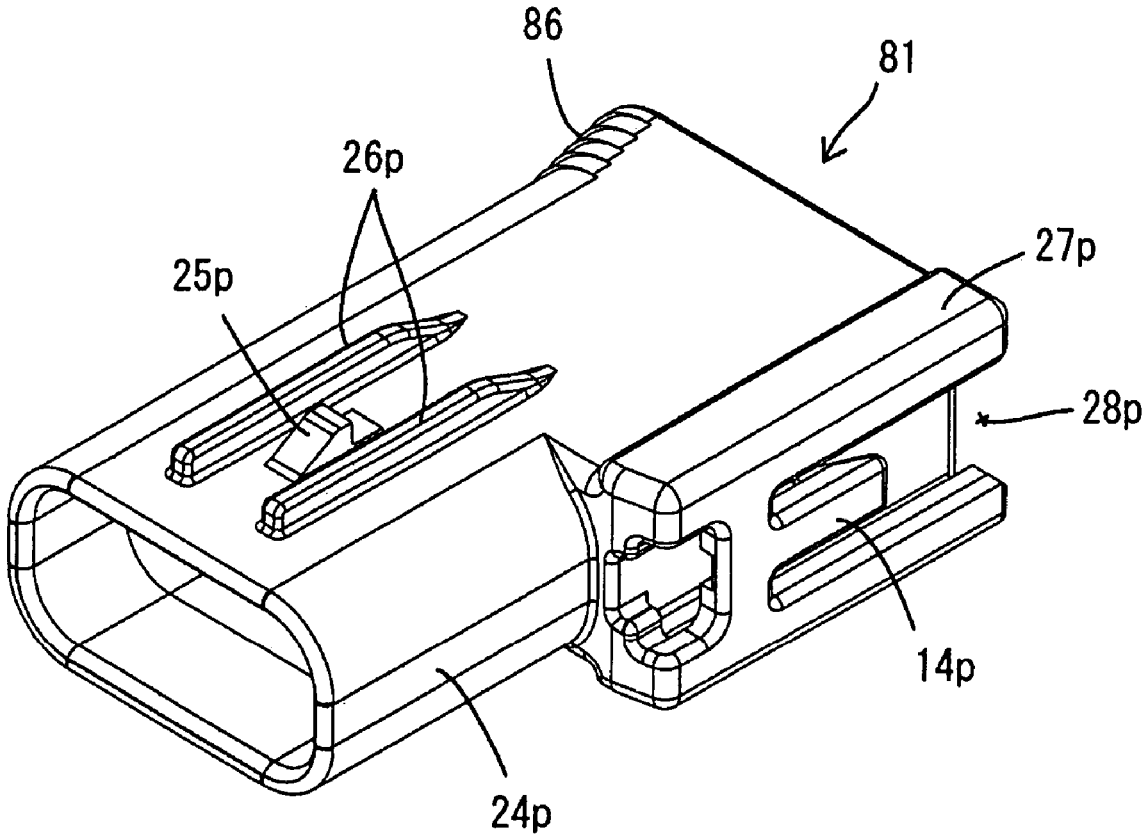
FIG. 21 is a perspective view showing a cap for use in the female connector.
Figure 22:
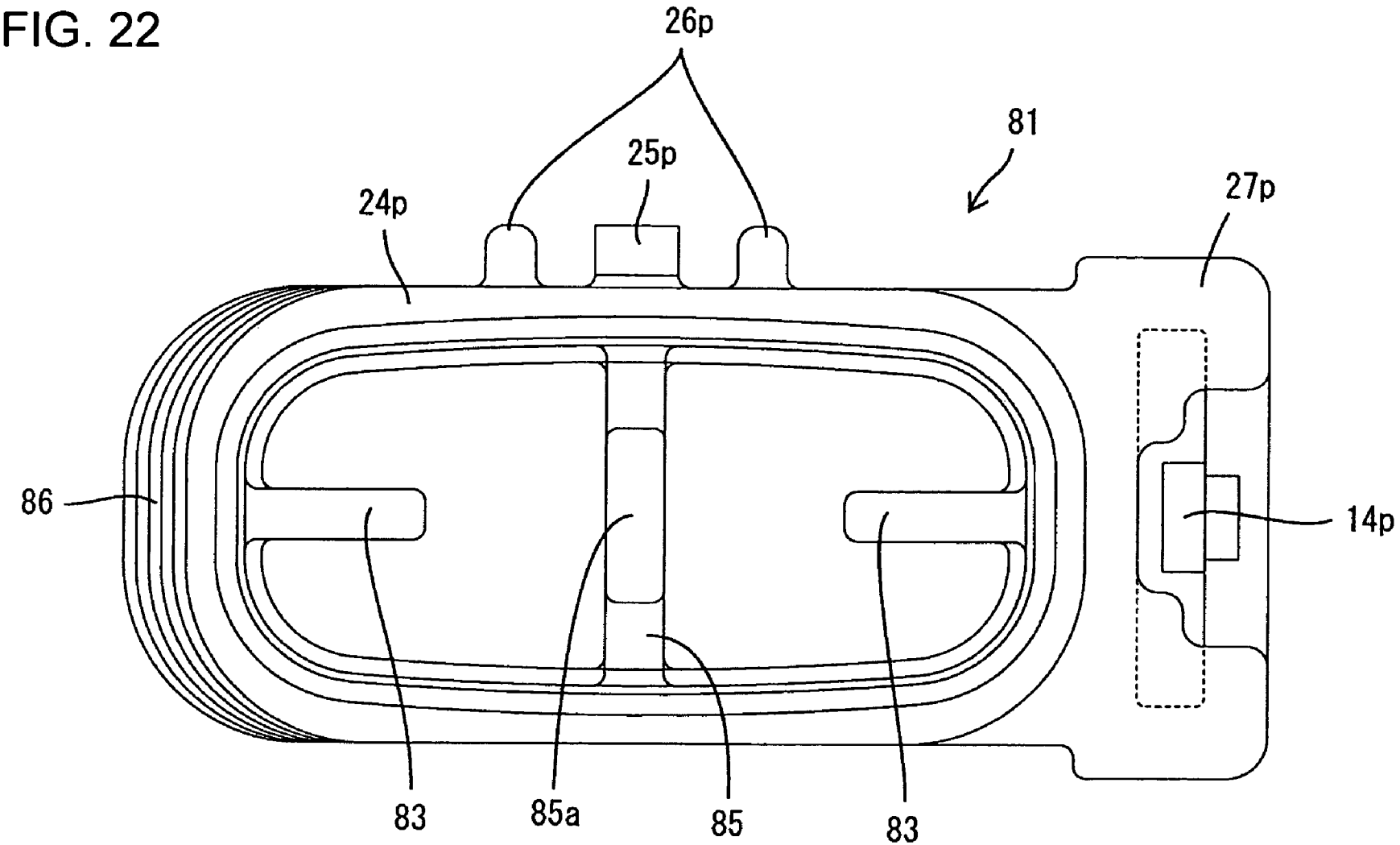
FIG. 22 is a front view showing the cap for use in the female connector.

The female connector 5 has a female housing 41 that is molded unitarily from a synthetic resin. The female housing 41 has a terminal-accommodating portion 42 for accommodating the female terminal fittings 35 and an outer tube 43 surrounds the terminal accommodating portion 42, as shown in FIGS. 9 and 15. The male connector 4 can be fit in the female connector 5 between the terminal-accommodating portion 42 and the outer tube 43. Four cavities 44 are arranged side by side in the width direction of the female housing 41 and penetrate the terminal-accommodating portion 42 longitudinally. Lances 45 are cantilevered obliquely forward from positions near front ends of the cavities 44 and each cavity 44 is open to allow the lance 45 to be exposed forward. Each lance 45 is capable of locking the projection 37 to hold the female terminal fitting 35 in the cavity 44. A seal tower 46 is formed at a rear of each cavity 44 (see FIG. 20) to accommodate the rubber plug 40 of the female terminal fitting 35.

A retainer insertion hole 47 is formed on the side surface of the terminal-accommodating portion 42 and traverses all of the cavities 44. More specifically, as shown in FIG. 15, the retainer insertion hole 47 penetrates the walls of the cavities 44 forward from a rubber ring 48 and rearward from the lance 45.

The female connector 5 also has a retainer 49 made of a synthetic resin. The retainer 49 has terminal-locks 50 for locking the female terminal fittings 35 and an operation piece 51 is formed at one end of the retainer 49. The retainer 49 is mounted in the terminal-accommodating portion 42 through a through-hole 52 that penetrates the outer tube 43 at a position confronting the retainer insertion hole 47. The terminal-lock 50 can be inserted into the retainer insertion hole 47. The retainer 49 is held at a temporary locking position at which the retainer 49 is inserted partly into the terminal-accommodating portion 42 and a main locking position at which the retainer 49 is inserted fully. A to-be-locked projection is formed in correspondence with each female terminal fitting 35 and moves into each cavity 44 for locking to the rear end of the tubular portion 36 of each female terminal fitting 35 when the retainer 49 is at the main locking position. Thus, the female terminal fitting 35 is locked doubly by the lance 45 and the to-be-locked projection. Each to-be-locked projection retreats from the corresponding cavity 44 at the temporary locking position to allow the female terminal fitting 35 to be inserted therein or removed therefrom.

A rubber ring 48 is fit at a rear end of the terminal-accommodating portion 42. The front edge of the hood 24 of the male connector 4 closely contacts the periphery of the rubber ring 48 when the male connector 4 has been fit in the female connector 5 to achieve a watertight fit between the male and female connectors 4, 5. A slit-like insertion hole 53 is formed vertically at the widthwise center of a front end surface of the terminal-accommodating portion 42 of the female connector 5, and can receive the gripping piece 34 of the retainer 18 of the male connector 4.

A cap-shaped front holder 54 is fit on a front end of the terminal-accommodating portion 42 (see FIG. 9). As shown in FIG. 15, a rear end of the front holder 54 contacts a front edge of the rubber ring 48 when the front holder 54 is mounted on the terminal-accommodating portion 42 to prevent the rubber ring 48 from slipping off the terminal-accommodating portion 42 when the male and female connectors 4, 5 are separated. The front holder 54 can receive a front end of the tubular portion 36 of the female terminal fitting 35. The front end of the tubular portion 36 of the female terminal fitting 35 contacts an inner surface of the front holder 54 to stop forward movement of the female terminal fitting 35 in the cavity 44. A tab insertion hole 55 penetrates the front holder 54 and is coaxial with the cavity 44. A vertically long escape hole 56 penetrates through a central portion of the front holder 54 in the width direction for receiving the gripping piece 34 of the male connector 4. The escape hole 56 matches the insertion hole 53 of the terminal-accommodating portion 42 and communicates therewith. A slit-like operation groove 57 (see FIG. 9) is formed on a side surface of the front holder 54 in the range from one widthwise end of the front surface of the front holder 54 so that a jig at the front of the front holder 54 can move the retainer 49 between the temporary and main locking positions. A concavity 58 is formed on the side surface of the front holder 54 and communicates with the operation groove 57. The operation piece 51 of the retainer 49 fits in the concavity 58 and is flush with a portion of the periphery of the front holder 54 when the retainer 49 is mounted normally in the terminal-accommodating portion 42.

A receiving groove 59 is formed on an inner surface of the outer tubular portion 43 and extends from a front end of the outer tubular portion 43 to a rear wall thereof. The receiving groove 59 is at a position aligned with the erroneous fit-in prevention rib 29 of the male connector 4 when the male and female connectors 4, 5 are oriented properly. However, the erroneous fit-in prevention rib 29 and the receiving groove 59 do not match and interfere with each other if the male connector 4 is attempted to be fit in the female connector in an improper orientation. Therefore the operator recognizes an erroneous orientation.

A protection frame 60 is disposed on the outer surface of the outer tubular portion 43 opposite to the side where the receiving groove 59 is formed. The inside of the protection frame 60 is open and can communicate with a fit-in space of the male connector 4 disposed in the outer tubular portion 43. The protection frame 60 is generally rectangular and has two side walls 60*a* that are erect over the whole length of the outer tubular portion 43. A front wall 60*b* connects the side walls 60*a* to each other and is flush with a front edge of the outer tubular portion 43. A rear wall 60*c* connects rear ends of the side walls 60*a* to each other and projects rearward beyond the outer tubular portion 43.

Figure 10:
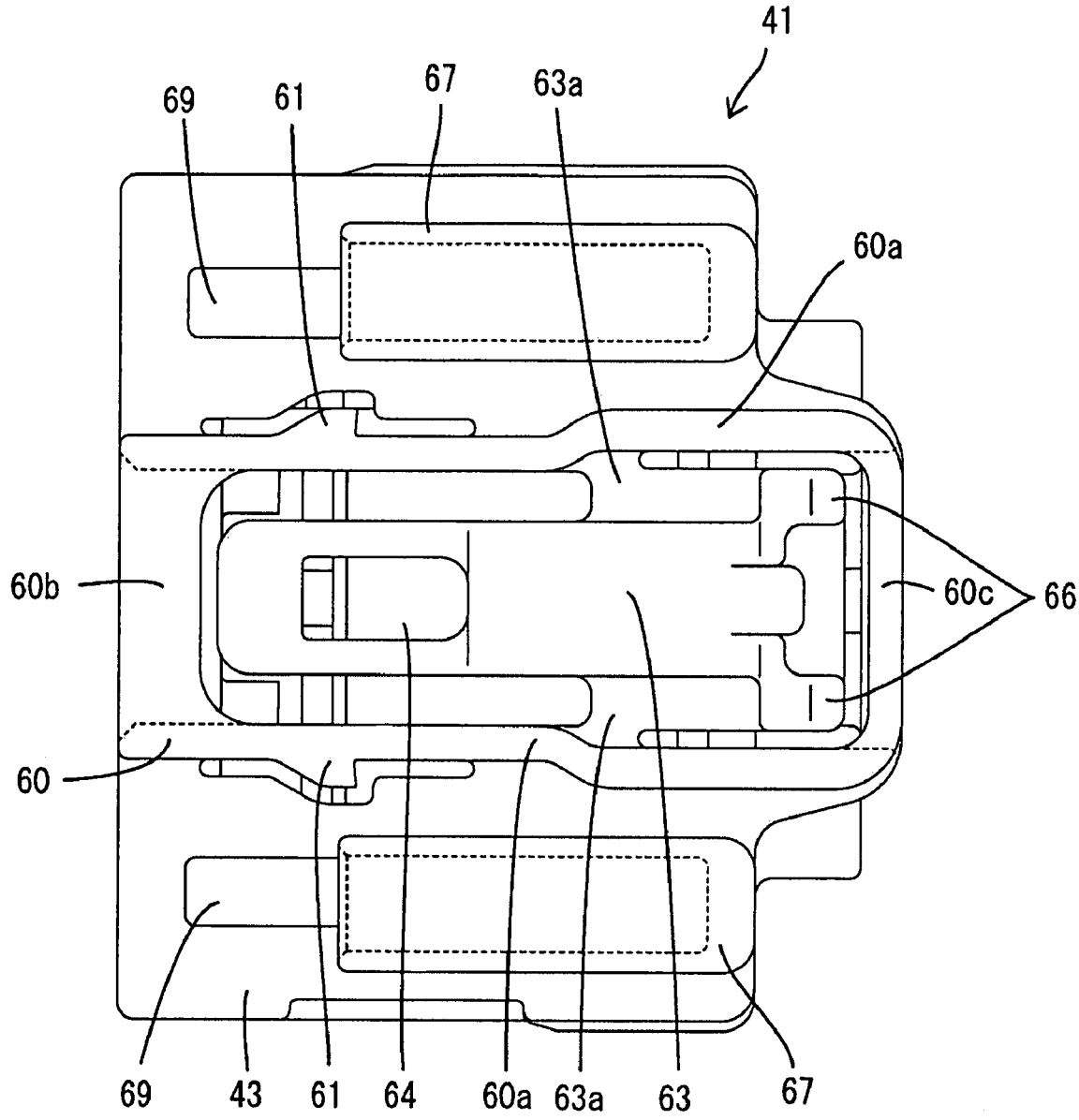
FIG. 10 is a plan view showing a female connector housing.
Figure 11:
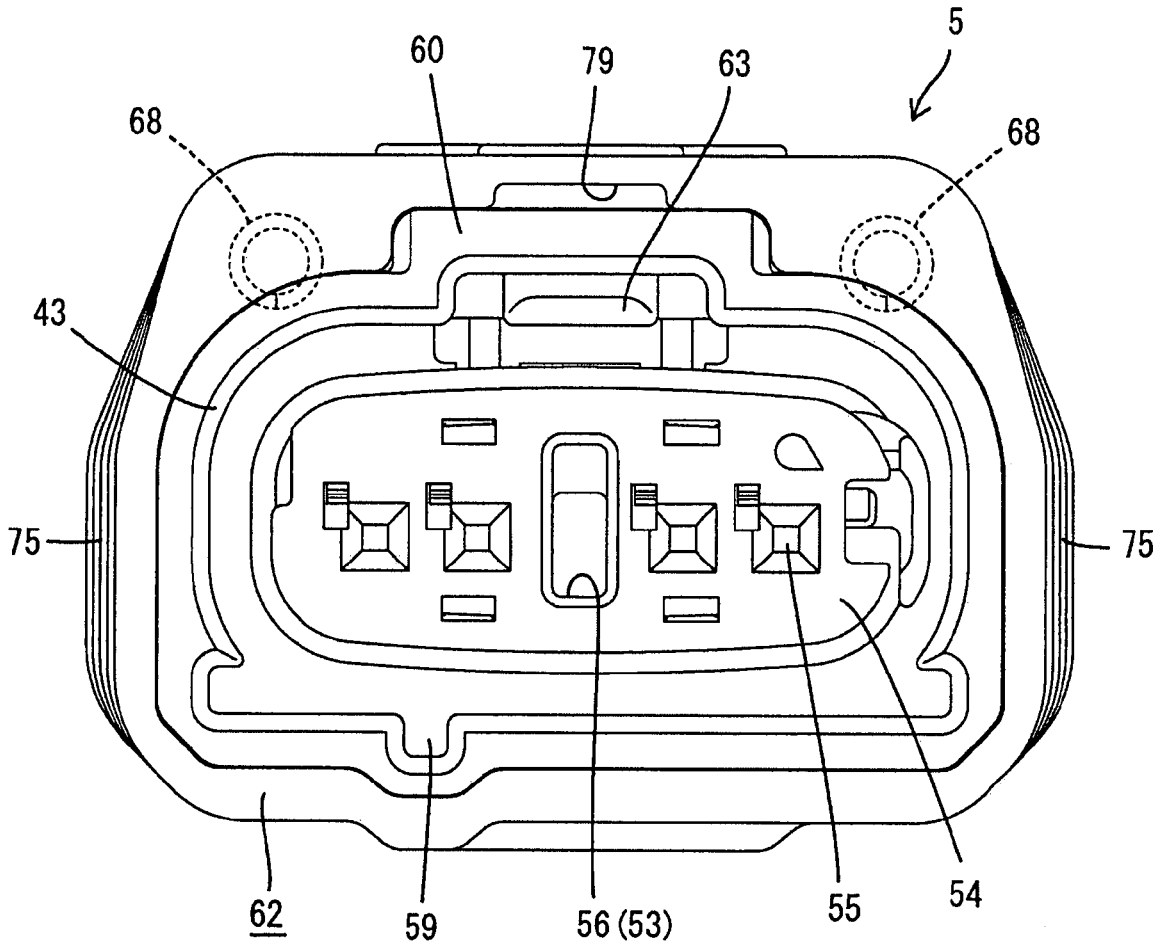
FIG. 11 is a front view showing the female connector.
Figure 12:
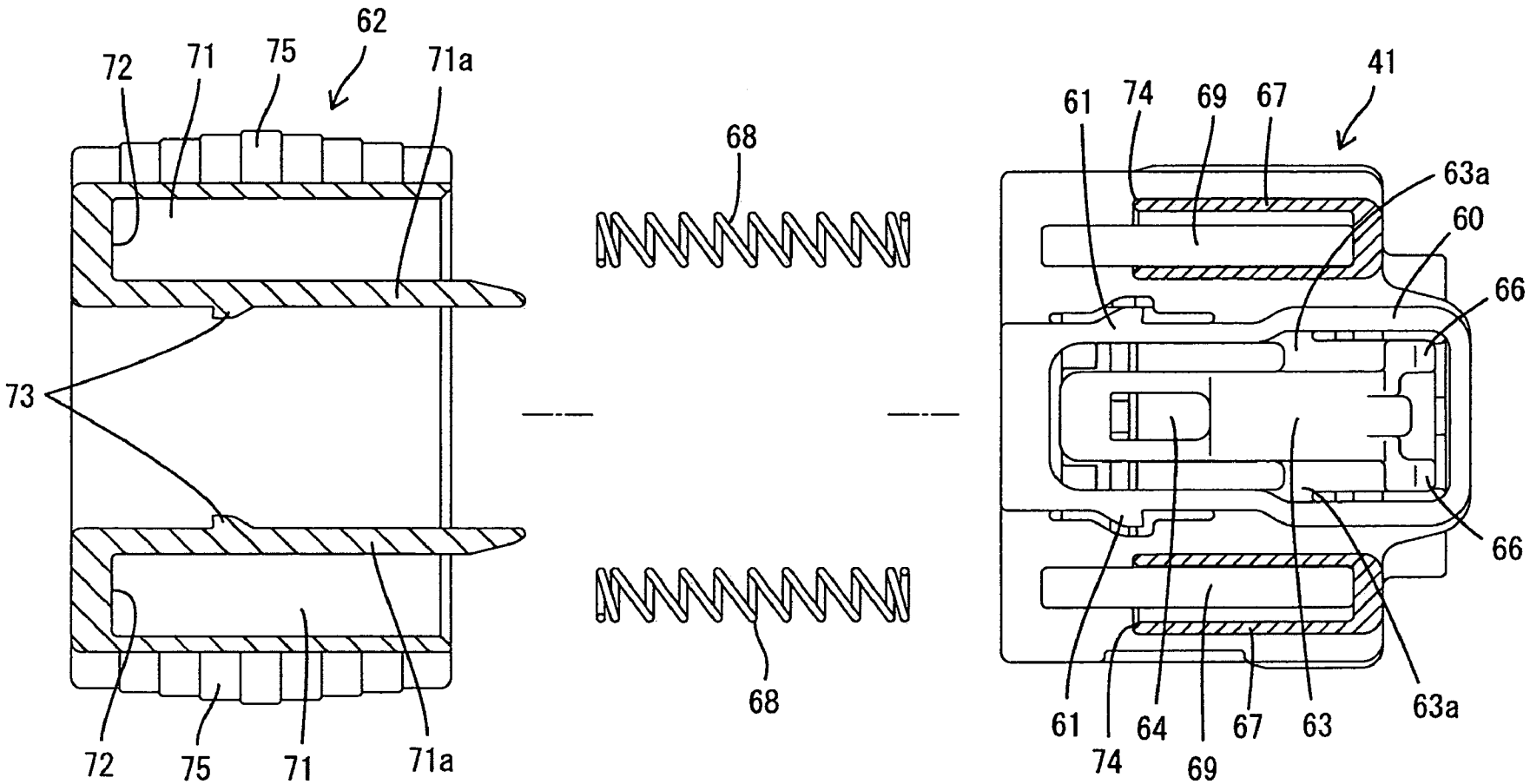
FIG. 12 is a plan sectional view showing an exploded state of the female connector.
Figure 13:
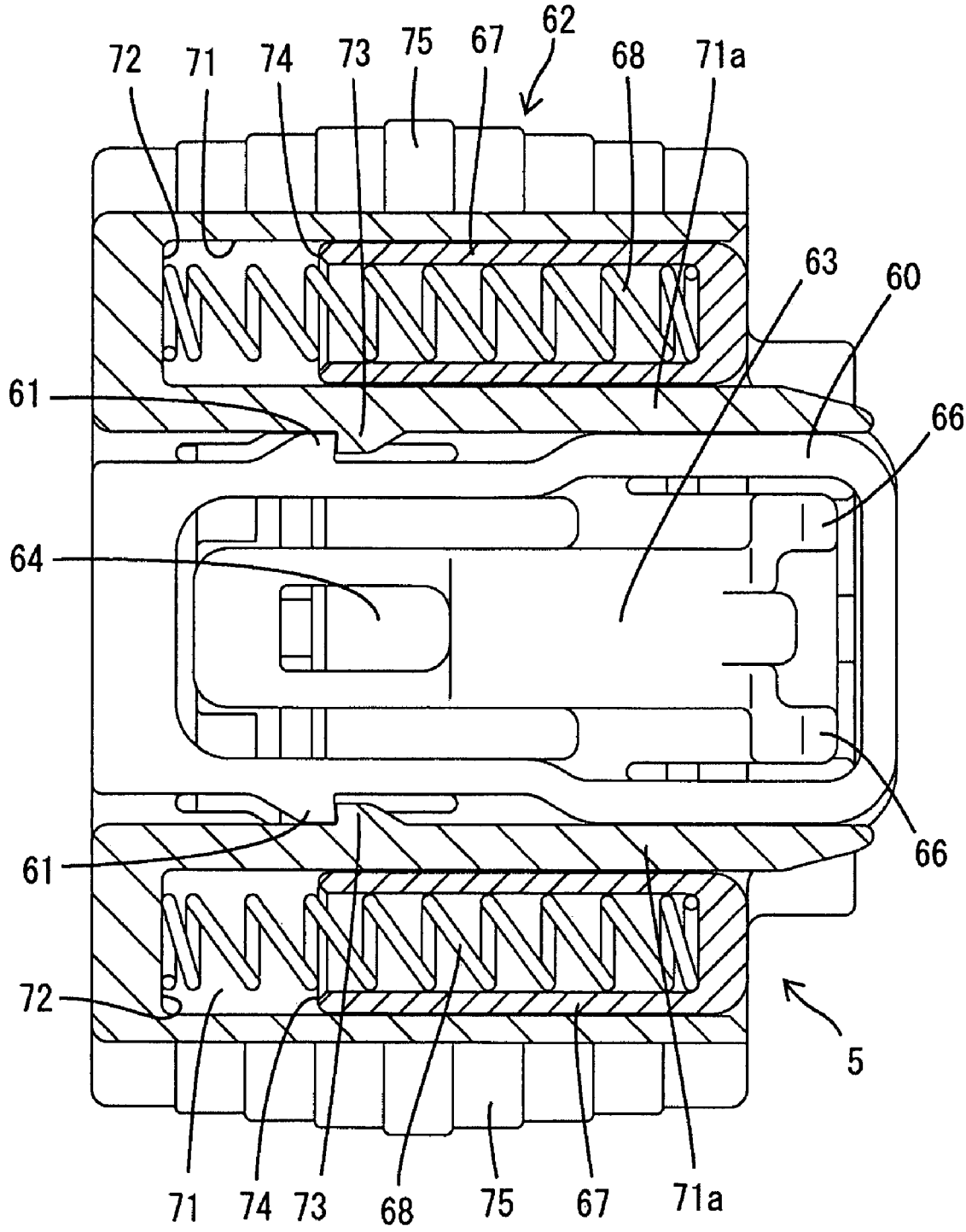
FIG. 13 is a plan sectional view showing a state in which the slider is mounted on the female connector.

As shown in FIGS. 10 and 13, a locking claw 61 is formed on an outer surface of both side walls 60*a* at a portion near the front end of the outer tubular portion 43. The locking claw 61 is locked to a slider 62 to prevent the slider 62 from slipping off forwardly.

A locking arm 63 is disposed inside the protection frame 60 and extends in the longitudinal direction of the female housing 41. A locking hole 64 penetrates a front portion of the locking arm 63 and engages the to-be-locked projection 25 of the male connector 4 when the male connector 4 has been fit properly in the female connector 5 to lock the connectors 4, 5 in a fit-in state. The locking arm 63 is connected with the side walls 60*a* by a hinge and the side walls 60*a* confront the locking arm 63 at midway positions of the side edges of the locking arm 63. The locking arm 63 can be displaced elastically like a seesaw in a vertical plane with the hinge as the center. Two coupling pieces 65 couple a lower surface of a rear end of the locking arm 63 and an upper portion of a rear end surface of the terminal-accommodating portion 42, as shown in FIG. 15. The coupling pieces 65 prevent the hinge from breaking when a strong upward external force acts on the rear end of the locking arm 63. Two laterally spaced unlocking projections 66 project up from the rear end of the locking arm 63. The upper end of each of the unlocking projections 66 is higher than the upper end of the side walls 60*a*.

Approximately cylindrical spring-accommodating portions 67 are disposed outward from the protection walls 60 and sandwich the locking arm 63 in the width direction of the female housing 41. The spring-accommodating portions 67 extend from a midway position on the outer surface of the outer tubular portion 43 to the rear end thereof. Front ends of the spring-accommodating portions 67 are open to accommodate a return spring 68 that urges the slider 62 in a return direction. An arc-shaped escape groove 69 is formed along the lower surface of the spring-accommodating portion 67 and extends forward beyond the front end of the spring-accommodating portion 67 in conformity to the peripheral configuration of the return spring 68.

Figure 14:
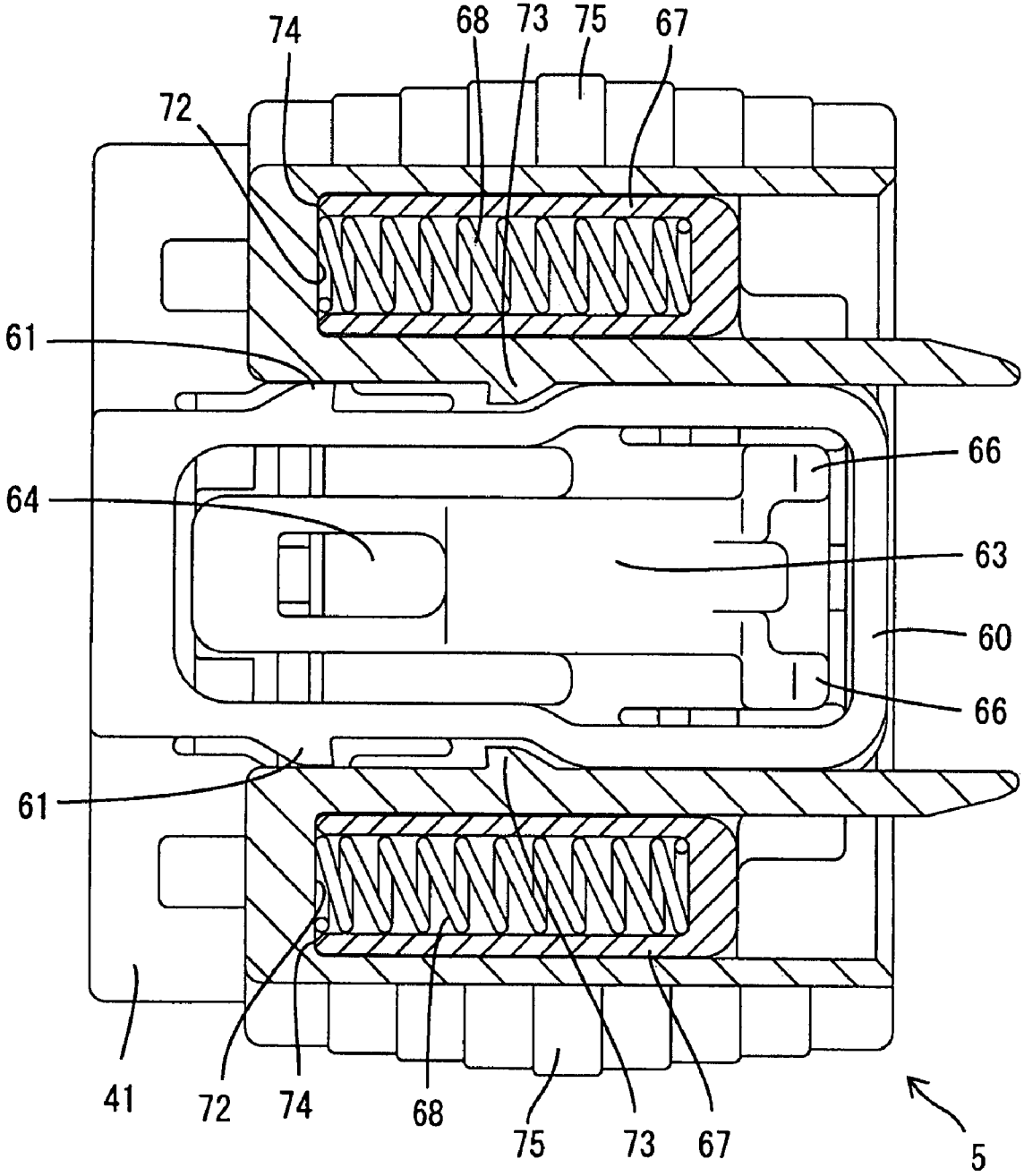
FIG. 14 is a plan sectional view showing a state after an operation of sliding the slider is performed.

The slider 62 is a tube that can fit onto the female housing 41 from the front and can slide in the direction in which the male connector 4 fits in and separates from the female connector 5. Side surfaces of the slider 62 have no openings, but an opening penetrates longitudinally through the slider 62. Although not shown in detail, ribs extend longitudinally on an inner surface of the slider 62 to decrease the area of contact between the slider 62 and the female housing 41 and hence to decrease the force required for sliding the slider 62. An arch 70 is formed at the center of an upper portion of the slider 62 at a position corresponding to the protection frame 60. The arch 70 extends longitudinally to prevent the slider 62 from interfering with the protection frame 60 when the slider 62 is mounted on the female connector 5. Two concave spring seats 71 open rearwardly on the inner surface of the slider 62 and can receive the spring-accommodating portions 67. A cover wall 72 of the slider 62 closes the front end of the spring seats 71 and contacts a front end of the return spring 68. Partition walls 71*a* are formed between the spring seats 71 and the arch 70 and hook claws 73 are formed at longitudinal central positions of the partition walls 71*a* for engaging the locking claw 61. The return spring 68 is pressed into the spring-accommodating portion 67 as the slider 62 is mounted on the female housing 41. As a result, the return spring 68 is compressed and locks the locking claw 61 and the hook claw 73 together, as shown in FIG. 13. Thus, the slider 62 is prevented from being removed forwardly from the female housing 41. The state shown in FIG. 13 is an initial mounting position of the slider 62, and front surfaces of the slider 62 and the female housing 41 are flush in this state. A rearward slide stroke of the slider 62 from the initial mounting position is prevented. As shown in FIG. 14, the cover wall 72 contacts a stop surface 74 on the periphery of an opening at the front end of the spring-accommodating portion 67 to prevent rearward movement of the slider 62.

Convexities and concavities are formed on both side surfaces of the slider 62 to define a finger-applying portion 75 that prevents an operator's fingers from slipping. Thus, the operator can grip and move the slider 62 rearward.

Figure 16:
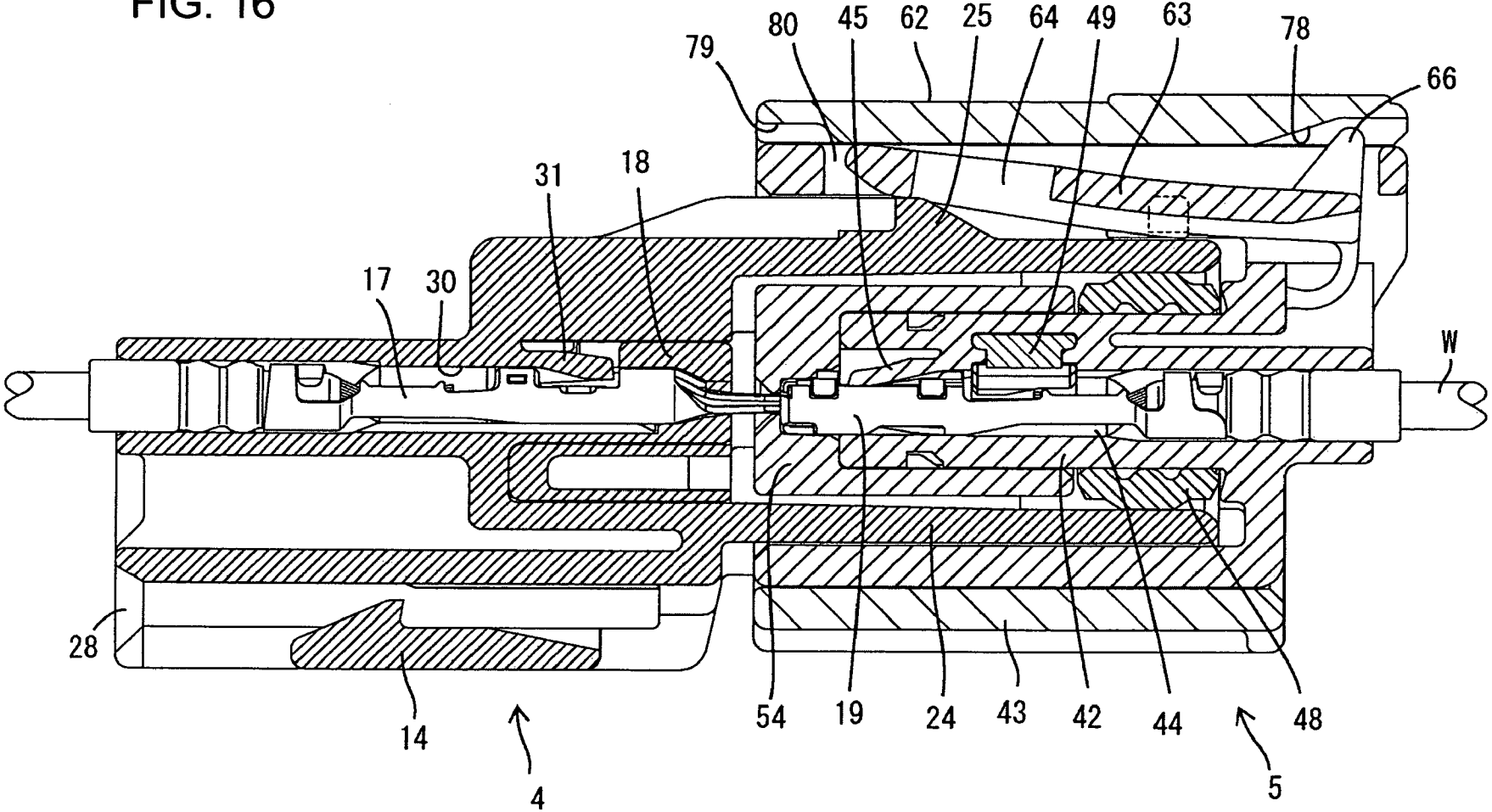
FIG. 16 is a side sectional view showing a state in which an operation of fitting of the male connector in the female connector is halfway.
Figure 17:
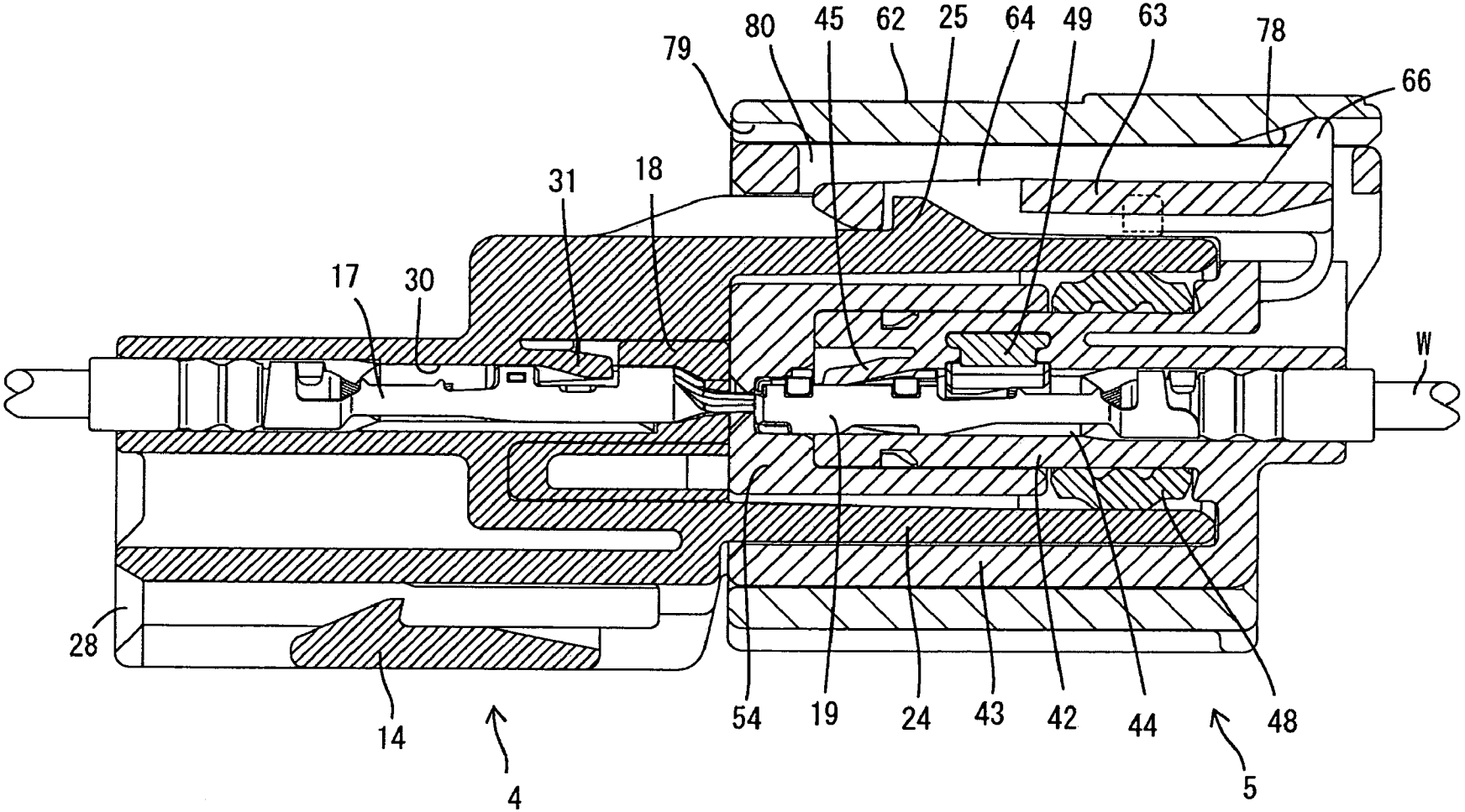
FIG. 17 is a side sectional view showing a state in which the male connector has been fitted in the female connector.

As shown in FIG. 9, a protrusion 76 projects rearwardly and horizontally from a widthwise central portion of the upper surface of the slider 62. An index 77 is raised from the slider 62 and extends from a midway portion of the upper surface of the slider 62 to the rear end of the protrusion 76. The index 77 is arrow-shaped and shows the direction in which the slider 62 is operated. As shown in FIG. 15, two unlocking guide surfaces 78 are formed on the reverse side of the protrusion 76 at positions corresponding to the unlocking projections 66 of the locking arm 63. The unlocking guide surfaces 78 allow the locking arm 63 to perform an unlocking operation. The unlocking guide surfaces 78 slope up and rearward so that a portion of the reverse side of the protrusion 76 is thinned gradually. The unlocking projections 66 contact the corresponding unlocking guide surfaces 78 when the slider 62 is at the initial position, as shown in FIG. 15. Therefore, a downward force is applied to the unlocking projections 66 when the slider 62 is moved rearward, and the front of the locking arm 63 is lifted. The locking hole 64 and the to-be-locked projection 25 unlock from each other when the unlocking projections 66 pass the unlocking guide surfaces 78 and reach a horizontal portion of the inner surface of the slider 62 (see FIG. 19). An interference-avoiding concavity 79 is formed on a widthwise central portion of the upper side of the front surface the slider 62 to prevent the locking arm 63 from interfering with the slider 62 when the front portion of the locking arm 63 is displaced to the position where the locking arm 63 and the to-be-locked projection 25 are unlocked from each other. A displacement-permitting space 80 is defined inside the slider 62 and above the locking arm 63 (see FIG. 16) so that the locking arm 63 can displace sufficiently to ride over the to-be-locked projection 25 when the male connector 4 is fit in the female connector 5.

A male cap 81 for the female connector 5 has a construction similar to the male housing 13 (see FIGS. 3 and 21 through 23). Parts of the male cap 81 that are similar to the male housing 13 have similar reference numerals, but "p" is put on end of the numeral for distinction. There is a fear that the male cap 81 may be mistaken for the male connector 4 in view of their similar appearances, and may be fit in the female connector 5 when the male connector should be fit in the female connector 5. Therefore, the male cap 81 is a different color than the male connector 4.

Figure 23:
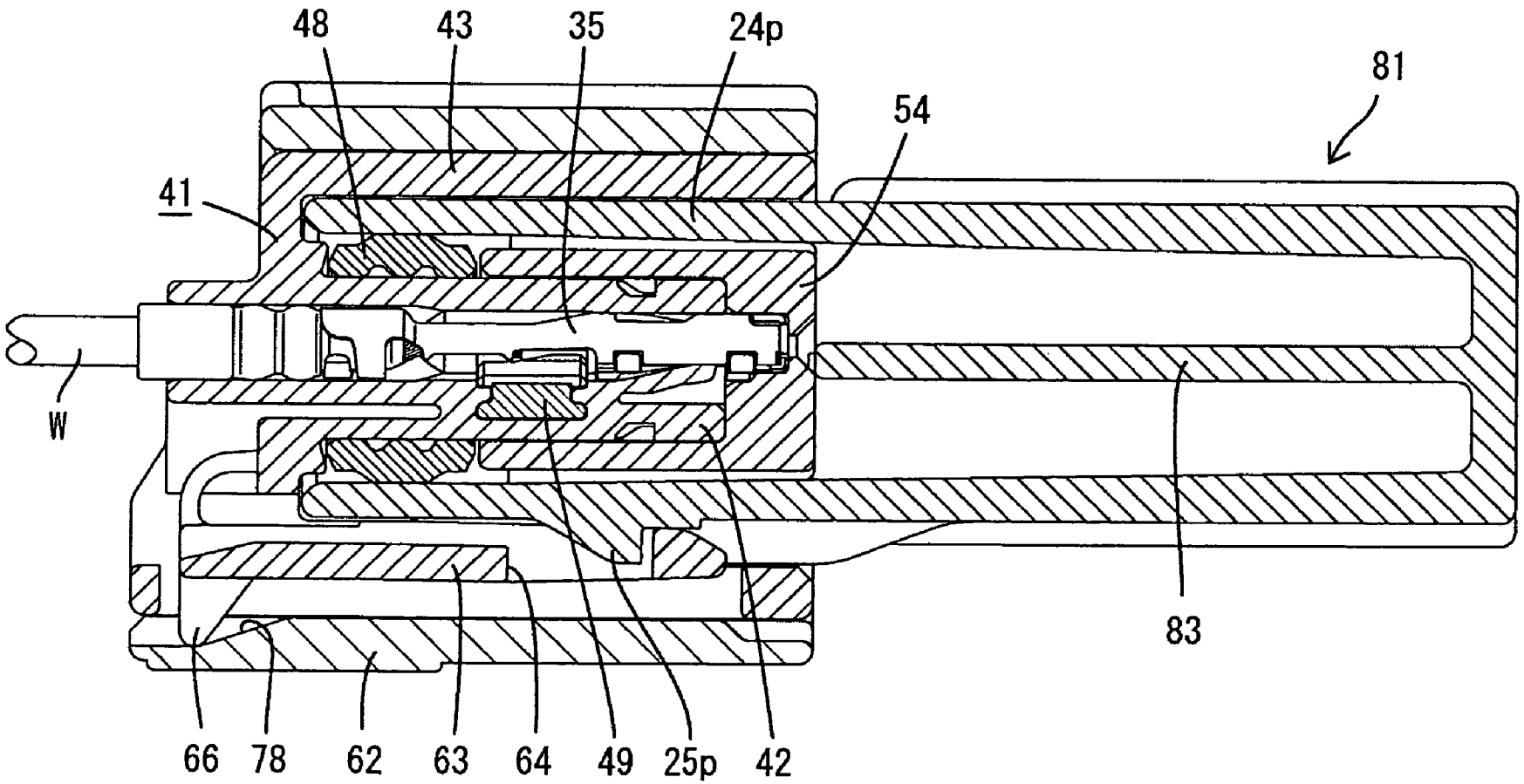
FIG. 23 is a side sectional view showing a state in which the cap is mounted on the female connector.

The male cap 81 is a tube that can fit in a space between the terminal accommodating portion 42 of the female connector 5 and the outer tube 43 thereof. More specifically, the rear half of the male cap 81 is approximately rectangular in section, whereas the front half thereof is approximately oblong in section. Unlike the male housing 13, a flat closing plate 82 extends across the rear of the male cap 81. Two opposed unlocking projections 83 project in from the vertical centers of inner surfaces of the shorter sides of the male cap 81. As shown in FIG. 23, the unlocking projections 83 contact a front surface of a front holder 54 of the female connector 5 when the male cap 81 is fit to a normal depth in the female connector 5 to restrict a fit-in depth. Alternatively, as shown in FIG. 3, the unlocking projections 83 contact a front surface of a front holder 54*p* of the female cap 84 when the male cap 81 is fit in a female cap 84 (described later) to restrict a fit-in depth. A vertical guide plate 85 in the male cap 81 connects widthwise central portions of both longer sides of the male cap 81 to each other. The guide plate 85 extends longitudinally forward from a rear wall of the male cap 81 farther than unlocking projections 83. However, a portion of the guide plate 85 that projects forward beyond the unlocking projections 83 is cut at upper and lower sides to form a short portion 85*a*. More specifically, the guide plate 85 has a length almost equal to the gripping piece 34. In fitting the male cap 81 in the female connector 5, the guide plate 85 is inserted into the insertion hole 53 of the female housing 41 through the escape hole 56 of the front holder 54.

Similar to the male connector 4, a to-be-locked projection 25*p* is formed in the front half of the outer surface of the male cap 81 between two protection walls 26*p*. A holding frame 27*p* similar to that of the male connector 4 is formed on the outer surface of the rear half of the male cap 81 on a surface that extends perpendicularly from the surface on which the to-be-locked projection 25*p* is formed. The locking portion of the to-be-locked claw 14 on the male connector 4 is cut off perpendicularly and makes surface contact with the hook piece 16 of the holder 8. Accordingly, the to-be-locked claw 14 and the hook 16 can be locked together at a high force. On the other hand, a to-be-locked claw 14*p* is formed inside the holding frame 27*p* of the male cap 81, but has a locking surface T that is tapered reversely, as shown in FIG. 3. Thus, the to-be-locked claw 14*p* makes point contact with the hook piece 16 and locks to the hook piece 16 with a low force to a small area.

The holding frame 27 is formed on the surface of the female connector 4 opposite to the surface on which the to-be-locked projection 25 is formed. On the other hand, the holding frame 27*p* in the male cap 81 is formed on the surface adjacent to the surface on which the to-be-locked projection 25*p* is formed. As shown in FIG. 2, the male cap 81 is mounted vertically on the holder 8, whereas the male connector 4 is mounted horizontally thereon due to the difference in the construction of the holding frames 27 and 27*p*. This difference has meaning that will be described in detail later.

In the male cap 81, a finger-applying portion 86 is formed at a side opposite to the side where the holding frame 27*p* is formed.

Figure 24:
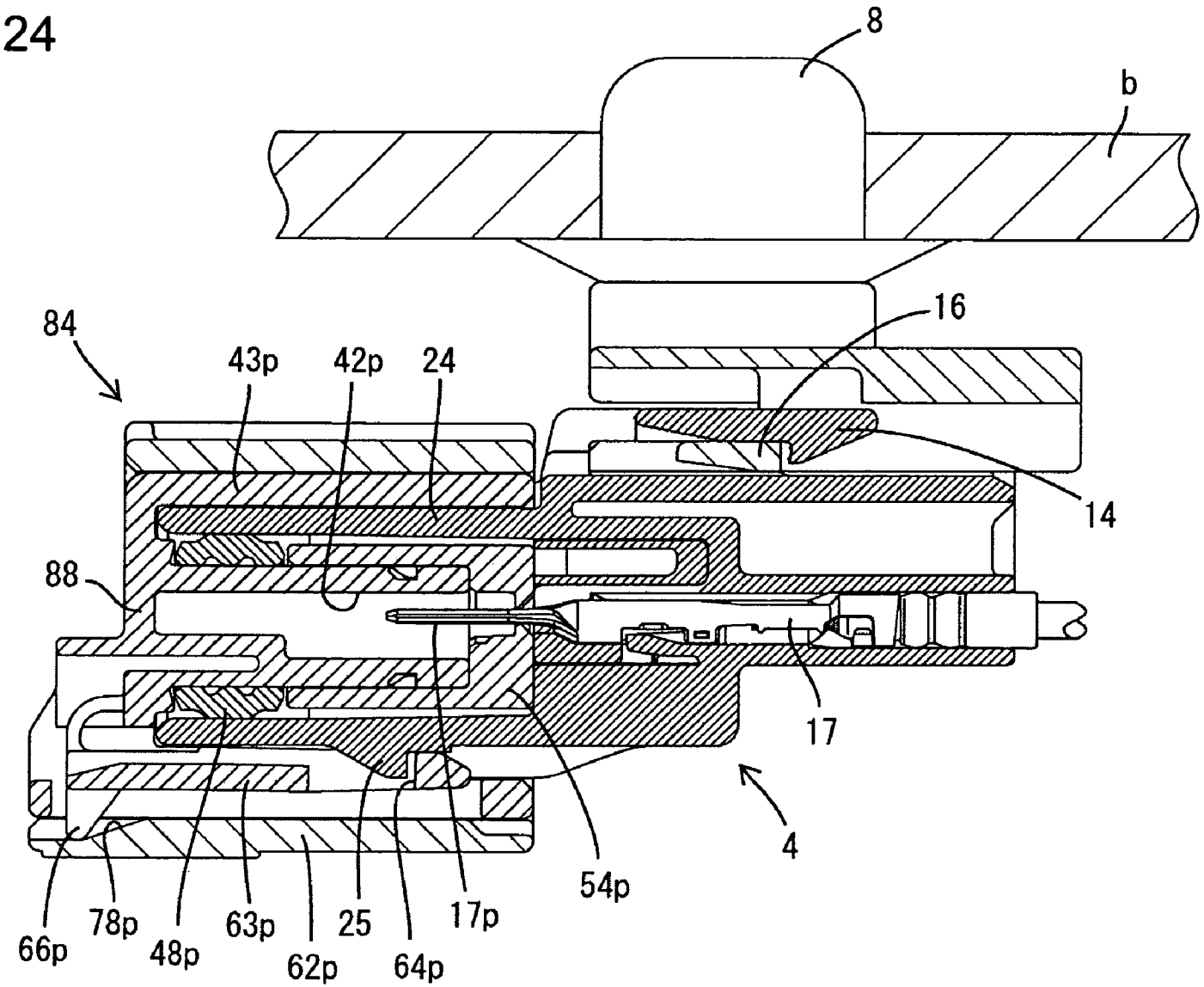
FIG. 24 is a side sectional view showing a state in which a cap is mounted on the male connector.

A female cap 84 for the male connector 4 is similar to the female connector 5 (see FIGS. 3 and 24). Parts of the female cap 84 that are similar to parts of the female connector 5 are denoted by the same reference numerals, but "p" is put on end of numeral for distinction. The female cap 84 is a different color than the female connector 5 to distinguish the two despite their similar appearances.

The female cap 84 has a housing 41*p*, a rubber ring 48*p*, a slider 62*p*, a front holder 54*p*, and a return spring (not shown) all similar to the female connector 5. Additionally, the housing 41*p* of the female cap 84 has a cavity with a construction corresponding to the cavity 44 of the female housing 41. However, a flat closing wall 88 extends across the rear of the housing 41*p* because there is no need to insert a terminal fitting. Similarly, the female cap 84 does not require a retainer. Therefore, the portion 42*p* of the female cap 84 has no retainer insertion hole and the outer tube 43*p* has no through-hole. Except for these differences, the housing 41*p* has a construction similar to the female housing 41.

A locking arm 63*p* formed in the housing 41*p* can be locked to the to-be-locked projection 25*p* of the male cap 81 and to the to-be-locked projection 25 of the male connector 4. The locking arm 63*p* can be unlocked from the to-be-locked projections 25 and 25*p* by rearward moving the slider 62*p* on the female cap 84.

The force for holding the male cap 81 on the holder 8 is defined by the force for locking the to-be-locked claw 14*p* of the male cap 81 and the hook 16 of the holder 8 to each other. This force is less than the force for locking the female cap 84 and the male cap 81 together, namely, the force for separating the female and male caps 84, 81 from each other by moving the slider 62*p* rearward (total of spring force of unshown return spring, frictional force between slider 62*p* and housing 41*p*, and frictional force between caps 81 and 84). Therefore when a pull-out operation is performed by holding the male cap 81 in the operators hand and when the slider 62 is moved rearward, the female cap 84 and the male cap 81 both are removed from the holder 8 with the male cap 81 fit in the female cap 84. The force for holding the male connector 4 on the holder 8, namely, the force for locking the to-be-locked claw 14 of the male connector 4 and the hook 16 of the holder 8 to each other is larger than the force for locking the male and female connectors 4, 5 to each other. Therefore in performing a separating operation, the female connector 5 is separated from the male connector 4, while the male connector 4 remains held by the holder 8.

FIG. 2 shows the state where the tail gate 3 is mounted on the vehicle body b. In this state, the male connector 4 is fit in the female connector 5, and both the male connector 4 and the female connector 5 are arranged alongside the connector-holding portion 12*a* of the holder 8. Similarly the male cap 81 is fit in the female cap 84, with the male cap 81 and the female cap 84 arranged alongside the cap-holding portion 12*b* of the holder 8.

The female connector 5 and the male connector 4 must be separated from each other when it is necessary to remove the tail gate 3 from the vehicle body b. Accordingly, the male cap 81 and the female cap 84 are removed from the holder 8 by pulling the male cap 81 leftward in FIG. 3. The portion of the to-be-locked claw 14*p* of the male cap 81 that is locked to the hook 16 of the holder 8 has the reversely tapered surface T. Thus, the to-be-locked claw 14*p* elastically deforms in an unlocking direction as the male cap 81 is being removed from the holder 8. As a result, the male and female caps 81 and 84 can be removed from the holder 8, with the male cap 81 fit in the female cap 84. In removing the male and female caps 81 and 84 from the holder 8, as shown in FIG. 2, the male and female caps 81, 84 are held vertically on the holder 8, whereas the male and female connectors 4, 5 are held sideways thereon. As a result, the finger-applying portion 86 of the slider 62*p* of the female cap 84 confronts the vehicle body b. This construction makes it difficult for the operator's fingers to be inserted therebetween. Thus, the male and female caps 81, 84 cannot be removed from each other before the male and female caps 81, 84 are removed from the holder 8 by operating the slider 62*p*. In addition, the force for separating the male cap 81 from the holder 8 is less than the force for separating the female cap 84 and the male cap 81 from each other. Therefore, even though the slider 62*p* is operated, the male and female caps 81, 84 are removed from the holder 8 in an interfitted state, and the male cap 81 will not be held on the holder 8.

Figure 18:
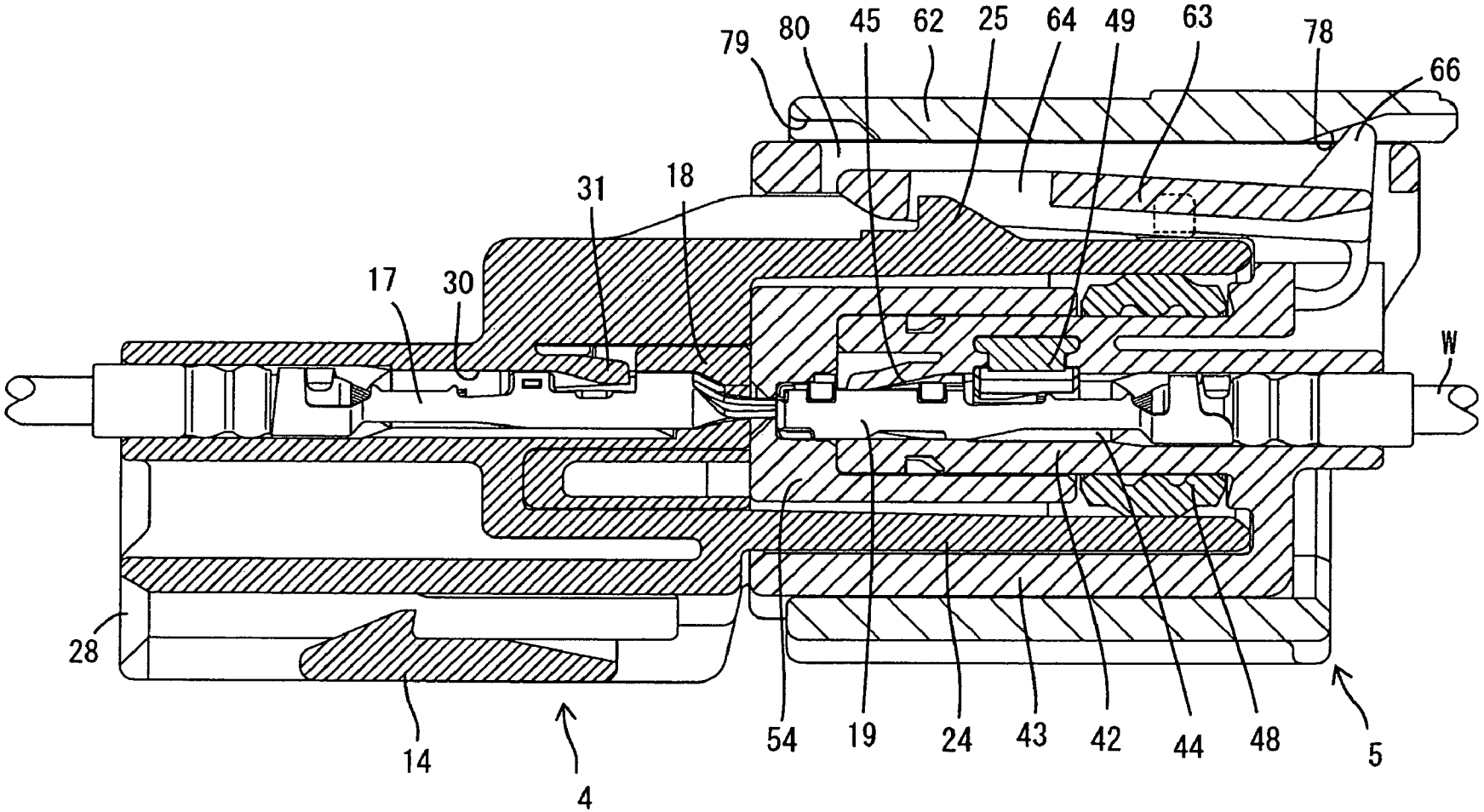
FIG. 18 is a side sectional view showing an initial state in an operation of separating the male connector from the female connector.

The operator then grips both finger-applying portions 75*p* of the slider 62*p* and pulls rearward in a direction in which the female and male caps 84, 81 are separated from each other. As a result, the locking arm 63*p* and the to-be-locked projection 25*p* are unlocked from each other. The operation to be performed at this time is similar to that to be performed in separating the male and female connectors 4, 5 from each other (see FIGS. 18 through 20). Thus the description of the operation to be performed at this time is omitted herein, but it is understood that the female and male caps 84, 81 can be separated from each other.

The male and female connectors 4, 5 are separated from each other after or before the female and male caps 84, 81 are separated from each other. More particularly, the slider 62 is gripped at opposite sides and moved rearward. As a result, both unlocking projections 66 of the locking arm 63 slide along the inclined surface of the unlocking guide surface 78 to apply a downward component of force to the unlocking projections 66 of the locking arm 63. As a result, the locking arm 63 is displaced like a seesaw with the hinge as a center, and the front portion thereof is lifted (see FIG. 18). Additional rearward movement of the slider 62 causes the unlocking projections 66 to pass the unlocking guide surface 78 and shifts to the straight portion of the inner surface of the slider 62. The front end of the locking arm 63 then enters the interference-avoiding concavity 79, and both locking holes 64 are unlocked from the to-be-locked projection 25 (see FIG. 19).

Figure 19:
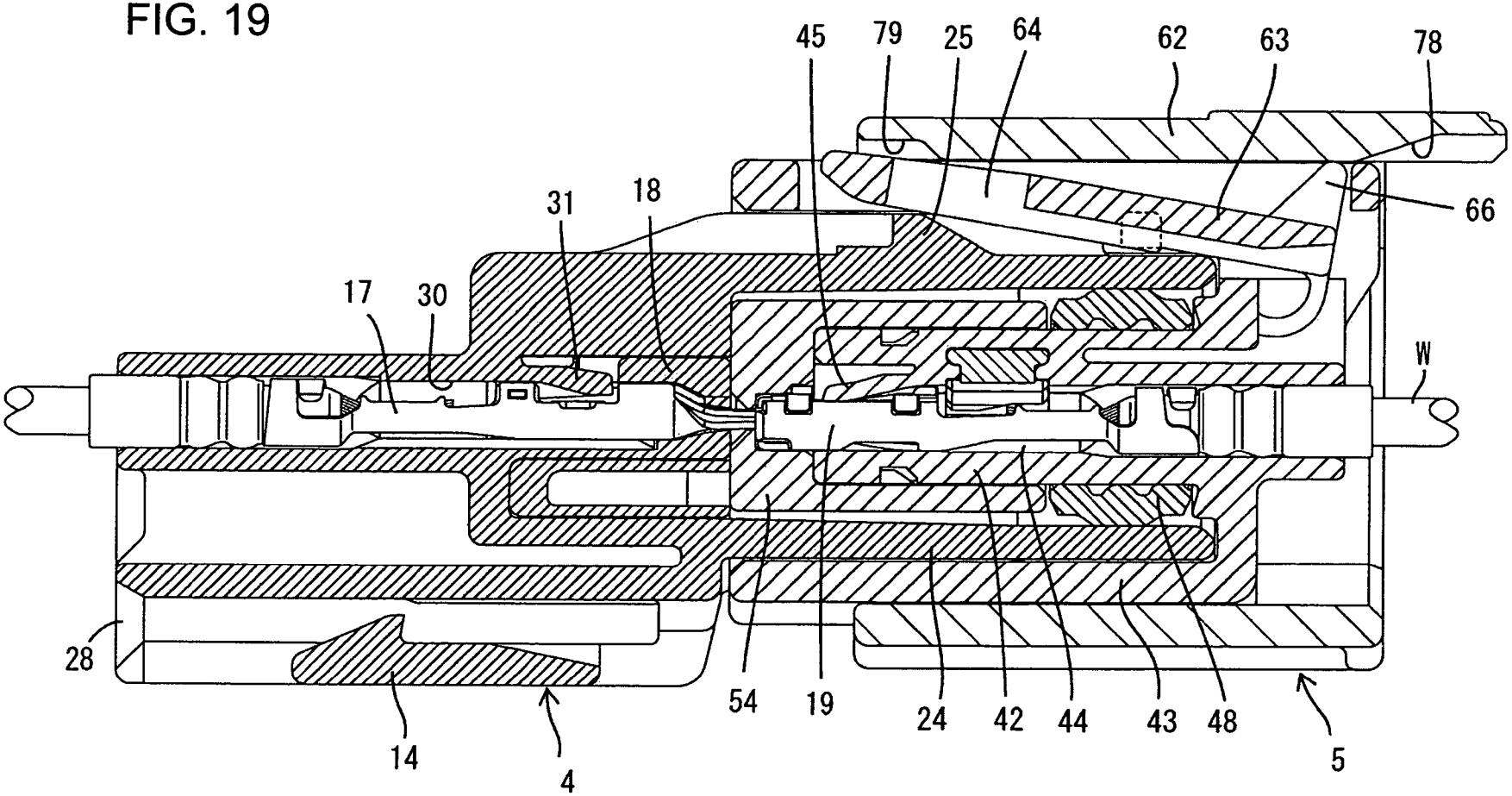
FIG. 19 is a side sectional view showing an intermediate state in the operation of separating the male connector from the female connector.

A compressive operation of the return spring 68 proceeds while the slider 62 is being moved rearward. Therefore the operation of moving the slider 62 rearward is performed in resistance to the spring force of both return springs 68. The return springs 68 are disposed symmetrically with respect to the locking arm 63 so that the slider 62 operates with a favorable widthwise balance. When both locking holes 64 are unlocked from the to-be-locked projection 25, as shown in FIG. 19, the cover wall 72 contacts the stopping surface 74 of the spring-accommodating portion 67, as shown in FIG. 14, and the return spring 68 cannot be compressed any more. As a result, the slider 62 and the female housing 41 are held together as a unit. Rearward operation of the slider 62 applies a force to the female housing for separating the female housing 41 from the male connector 4. Thus, the female housing 41 can be removed from the male connector 4. The force for separating the male and female connectors 4, 5 from each other is less than the force for separating the male connector 4 from the holder 8. Therefore only the female connector 5 can be removed from the holder 8, with the male connector 4 held by the holder 8. After the male and female connectors 4, 5 are removed from each other, the male connector 4 and the female connector 5 are covered respectively with the female cap 84 and the male cap 81.

As shown in FIG. 23, an operation of fitting the male cap 81 in the female connector 5 is performed by fitting the male cap 81 into the space between the terminal-accommodating portion 42 of the female connector 5 and the outer tube 43 thereof. The guide plate 85 is inserted into the escape hole 56 and the insertion hole 53 while the fit-in operation is being performed. At the same time, the front end of the locking arm 63 rides over the to-be-locked projection 25*p* of the male cap 81. The locking arm 63 rides across the to-be-locked projection 25*p* and enters the locking holes 64 when both unlocking projections 83 contact the front surface of the front holder 54. Thus, the female connector 5 is covered with the male cap 81, and the male cap 81 is prevented from slipping off the female connector 5 (see FIG. 23).

The slider 62 is moved rearward to unlock the male cap 81 and the female connector 5 from each other. Thus, the male cap 81 and the female connector 5 are unlocked and separated from each other by performing the above-described procedure.

As shown in FIG. 24, an operation of fitting the male connector 4 in the female cap 81 is performed while the male connector 4 is held by the holder 8 on the vehicle body b. In this fit-in operation, the tabs 17*b* of the male terminal fittings 17 are inserted into corresponding cavities (not functioning as cavity). At the same time, the locking arm 63*p* rides over the to-be-locked projection 25. The locking arm 63*p* returns to its original state and locks the to-be-locked projection 25 when the male connector 4 is fit in the female cap 81 to a normal depth. Thus, the female cap 84 covers the male connector 4 and is prevented from slipping off the male connector 4 (see FIG. 24). The male connector 4 and the female cap 84 can be unlocked from each other by moving the slider 62 rearward.

The tail gate 3 is removed from the bed 2 of the vehicle body b after the male cap 81 is mounted on the female connector 5 and the female cap 84 is mounted on the male connector 4,. The male cap 81 covers the female connector 5 and electric wires are disposed at the side of the tail gate 3, whereas the female cap 84 covers the male connector 4 at the side of the vehicle body b, with the male and female caps 81, 84 and the male and female connectors 4, 5 held by the holder 8. Thus, the male and female connectors 4, 5 are waterproof and dustproof.

The female and male caps 84 and 81 are removed from the male and female connectors 4, 5 respectively by reversing the above-described procedure when the tail gate 3 is to be mounted on the bed 2. The female and male caps 84 and 81 easily can be removed from the male and female connectors 4, 5 respectively by moving the sliders 62, 62*p* rearward. The operation of fitting the male cap 81 in the female cap 84 and in the female connector 5 and fitting the male connector 4 in the female connector 5 and in the female cap 84 are performed in the same way. Thus further description of the fit-in operations is omitted.

The operation of merely moving the sliders 62, 62*p* rearward suffices for unlocking and separating the male and female connectors 4, 5 from each other, the female and male caps 84, 81 from each other, the male connector 4 and the female cap 84 from each other, and the male cap 81 and the female connector 5 from each other. The prior art two-step operation of operating the locking arm and then performing a removing operation is not needed. Therefore the cap-holding construction of the invention is excellent in an unlocking operation.

The sliders 62, 62*p* do not have an opening on the surfaces thereof and cover the peripheral surfaces of the housings of the connectors or the caps. Therefore, foreign matter cannot penetrate into the sliders 62, 62*p* and the sliders 62, 62*p* can be moved smoothly.

The stopping surfaces 74 are symmetrical with respect to the locking arm 63, 63*p*. Hence the sliders 62, 62*p* can be moved rearward in a favorable balance.

Because the stopping surfaces 74 are formed by utilizing the spring-accommodating portion 67, it is possible to make the construction of the connector of the present invention simpler than a construction having the stopping surfaces 74 formed separately.

The displaceable space in which the locking arm 63 is capable of riding over the to-be-locked projection 25 is secured inside each of the sliders 62, 62*p*. The unlocking projections 66 are erected from the locking arm 63 to fill the gap between the locking arm 63 and each of the sliders 62, 62*p*. Thus, the unlocking mechanism interlocked with the rearward movement of the sliders 62, 62*p* is established and an opening is not formed on the peripheral surfaces of the sliders 62, 62*p*.

The male and female caps 81, 84 covering the male and female connectors 4, 5 are held by the holder 8, with the male and female caps 81, 84 disposed alongside the male and female connectors 4, 5. Thus, the male and female caps 81, 84 will not be lost. Further the male and female caps 81, 84 are held by the holder 8, with the male cap 81 fit in the female cap 84. This construction allows the cap management space to be smaller than a cap management space where the male and female caps 81, 84 are held separately by a holder.

The posture of the finger-applying portion 75*p* is so set that one side surface thereof confronts the vehicle body b in the state in which the male and female caps 81, 84 are held by the holder 8. Therefore it is difficult to operate the slider 62*p* and the male and female caps 81, 84 from being separated from each other while the male cap 81 is held by the holder 8. Therefore, the operator is prevented from covering the male connector 4 with the female cap 84, but not covering the female connector with the male cap 81.

The force for separating the male cap 81 from the holder 8 is less than the force for separating the male and female caps 81, 84 from each other. This construction allows the effect described above.

The force for separating the male and female connectors 4, 5 from each other is set smaller than the force for separating the male connector 4 from the holder 8. Therefore it is possible to securely keep the male connector 4 held by the holder 8 because it is unnecessary to remove the male connector 4 from the holder 8.

The inclination of one side of the finger-applying portion 75 and that of the other side thereof with respect to the center thereof are reversed to each other. Therefore it is easy for the operator to hold the finger-applying portion 75 in performing fit-in and separation operations.

The invention is not limited to the embodiment described above with reference to the drawings. For example, the following embodiments are included in the technical scope of the invention. Further, various other modifications can be made without departing from the spirit and scope of the invention.

The unlocking guide surface 78 is formed on the slider 62. However, the unlocking guide surface 78 could be on the female housing where the locking arm is formed. The unlocking projected portion 66 may project from the slider 62 towards the female housing where the locking arm 63 is formed.

The slider 62 does not have to be a tube surrounding the entire periphery of the female housing, and may partly cover the female connector housing.

Two return springs 68 are not necessary. Rather, one return spring 68 may be above the locking arm 63 at the widthwise center of the female housing.

The cap-holding portion 12*b* and the connector-holding portion 12*a* are set on one holder 8, but may be formed on separate holders.

What is claimed is:

1. An assembly of fit-in members, comprising:

first and second fit-in members configured so that the first fit-in member is fittable in the second fit-in member;

a locking arm disposed on the first fit-in member;

a to-be-locked portion disposed on the second fit-in member and locked to the locking arm when the first fit-in member is fitted in the second fit-in member;

a slider mounted on the first fit-in member for sliding movement along a direction in which the first fit-in member is separated from the second fit-in member;

an interlocking portion, on at least one of the slider and the locking arm, for displacing the locking arm in a direction in which the locking arm is unlocked from the to-be-locked portion in association with an operation of sliding the slider; and a stopping surface provided on the first fit-in member for contacting the slider when the locking arm is unlocked from the to-be-locked portion and holding the slider and the first fit-in member together as a unit and preventing further sliding of the slider relative to the first fit-in member.

2. The assembly of fit-in member of claim 1, wherein the slider is substantially tubular and opens in directions in which the first fit-in member is fit in and separated from the second fit-in member, the slider surrounding an entire periphery of a housing of the first fit-in member.

3. The assembly of fit-in members of claim 2, wherein finger-applying portions are formed on opposite outer surfaces of said slider and have convex and concave portions for preventing slippage of an operator's fingers.

4. The assembly of fit-in members of claim 3, wherein said finger-applying portion defines a maximum thickness at a central portion of the slider along the directions in which the first fit-in member is fit in and separated from the second fit-in member direction and defines reduced thicknesses at locations spaced farther distances from the central portion in the directions in which the first fit-in member is fit in and separated from the second fit-in member.

5. The assembly of fit-in members of claim 1, wherein at least one return spring is incorporated in the first fit-in member and extends along the directions in which the first fit-in member is fit in and separated from the second fit-in member; one end of the return spring contacting a housing of the first fit-in member, an opposite end of the return spring contacting the slider for urging the slider in a return direction away from the second fit-in member.

6. The assembly of fit-in members of claim 1, wherein the locking arm is provided at a widthwise central portion of an outer surface of a housing of the first fit-in member, the locking arm being aligned in the direction in which said first fit-in member is fit in and separated from said second fit-in member; and two stopping surfaces being formed at positions sandwiching the locking arm therebetween in the widthwise direction of said housing, the stopping surfaces being disposed symmetrically with respect to the locking arm.

7. The assembly of fit-in members of claim 6, wherein a spring-accommodating portion is formed on the first fit-in member; the return spring being incorporated in the first fit-in member by inserting the return spring therein from an end surface of an opening of the spring-accommodating portion; and a peripheral portion of the opening of the spring-accommodating portion is formed as said stopping surfaces.

8. The assembly of fit-in members of claim 1, wherein the locking arm has opposite front and rear ends and a fulcrum between the ends, the locking arm being displaceable in a plane and about the fulcrum; a lock being formed in proximity to the front end of the locking arm and being engageable with the to-be-locked portion; an unlocking portion being formed in proximity to the rear end of the locking arm; and an inclined unlocking guide surface being formed on one of the rear end of the locking arm and the slider, the unlocking guide surface being configured for displacing the locking arm in a direction to disengage said lock from the to-be-locked portion as the slider is slid away from the second fit-in member.

9. The assembly of fit-in members of claim 8, wherein the front end of said locking arm rides across the to-be-locked projection and deforms while fitting the first fit-in member in the second fit-in member, and elastically returns to an original state thereof when the first and second fit-in members are fit together completely; the slider having a displacement-permitting space for permitting a the deflection of the locking arm.

10. The assembly of fit-in members of claim 1, wherein both of the fit-in members are connectors.

11. The assembly of fit-in members of claim 1, wherein the first fit-in member is a cap and the second fit-in member is a connector.

12. An connector assembly, comprising:

first and second connectors configured so that at least part of the first connector is fittable in the second connector along a mating direction, the first connector having a housing;

a locking arm disposed on the first connector, the locking arm being provided at a widthwise central portion of an outer surface of the housing of the first connector and being aligned substantially along the mating direction;

a to-be-locked portion disposed on the second connector and being in locked engagement with the locking arm when the first connector is fit in the second connector;

a substantially tubular slider that opens in the mating direction, the slider being mounted on and surrounding an entire periphery of the housing of the first connector for sliding movement along the mating direction;

an interlocking portion on at least one of the slider and the locking arm for displacing the locking arm out of engagement with the to-be-locked portion in association with sliding movement of the slider;

two stopping surfaces formed on the housing of the first connector at positions sandwiching the locking arm therebetween in a widthwise direction of the housing, for contacting the slider when the locking arm is unlocked from the to-be-locked portion and holding the slider and preventing further sliding of said slider relative to the connector; and at least one return spring incorporated in the first connector and extending along the mating direction, one end of the return spring contacting the housing of the first connector and an opposite end of the return spring contacting the slider for urging the slider in a return direction away from the second connector, a spring accommodating portion being formed on the first connector and accommodating the return spring therein through an opening in an end surface of the spring accommodating portion, a peripheral portion of the opening of the spring-accommodating portion defining the stopping surfaces.

13. The connector assembly of claim 12, wherein finger-applying portions are formed on opposite outer surfaces of the slider and have convex and concave portions for preventing slippage of an operator's fingers.

14. The connector assembly of claim 13, wherein said finger-applying portions define a maximum thickness at a central portion of the slider along the mating direction and define reduced thicknesses at locations spaced farther distances from the central portion along the mating direction.

15. The connector assembly of claim 12, wherein, the stopping surfaces are disposed symmetrically with respect to the locking arm.

16. The connector assembly of claim 12, wherein the locking arm has opposite front and rear ends and a fulcrum between the ends, the locking arm being displaceable in a plane and about the fulcrum; a lock being formed in proximity to a front end of the locking arm and being engageable with the to-be-locked portion; an unlocking portion being formed in proximity to the rear end of the locking arm; and an inclined unlocking guide surface being formed on one of the rear end of the locking arm and the slider, the unlocking guide surface being configured for displacing the locking arm out of engagement with the to-be-locked portion as the slider is slid away from the second connector.

* * * * *